US006700565B2

(12) United States Patent
Niiyama

(10) Patent No.: US 6,700,565 B2
(45) Date of Patent: Mar. 2, 2004

(54) SLIDE SWITCH

(75) Inventor: Takashi Niiyama, Gunma-ken (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 10/016,652

(22) Filed: Oct. 30, 2001

(65) Prior Publication Data

US 2002/0104743 A1 Aug. 8, 2002

(30) Foreign Application Priority Data

Oct. 31, 2000 (JP) ..... 2000-333129
Apr. 13, 2001 (JP) ..... 2001-115808
Jul. 18, 2001 (JP) ..... 2001-218197

(51) Int. Cl.[7] ..... G09G 5/00
(52) U.S. Cl. ..... 345/172; 345/161; 200/5 A
(58) Field of Search ..... 345/156, 157, 345/161, 172; 200/5 A, 5 B, 5 R

(56) References Cited

U.S. PATENT DOCUMENTS 5,473,325 A * 12/1995 McAlindon ..... 341/20
6,266,046 B1 * 7/2001 Arita ..... 345/156
6,362,810 B1 * 3/2002 Matsuda ..... 345/161

FOREIGN PATENT DOCUMENTS

JP 10-302576 A * 11/1998 ..... H01A/25/00
JP 7235240 9/1999

* cited by examiner

*Primary Examiner*—Amr Awad
(74) *Attorney, Agent, or Firm*—Webb Ziesenheim Logsdon Orkin & Hanson, P.C.

(57) ABSTRACT

A slide switch includes a case member; a slide member movable within a planar range of movement, conducting elements formed between the case member and the slide member, and an elastic member for holding the slide member in a neutral position where the conducting elements are non-conductive. The elastic member is an integral unit having a holding portion engaged with the slide member, and projecting portions extending from the holding portion along the planar range of movement toward inner walls of the case member. The conducting elements include contacts arranged on the inner wall of the case member, and conductors arranged on the holding portion of the elastic member. The conductors of the elastic member are movable into contact with the contacts of the case member by an external force for moving the slide member away from the neutral position against a biasing force of the elastic member, and separable from the contacts by the biasing force of the elastic member when the external force is removed.

20 Claims, 18 Drawing Sheets

X
Y
Z
200
21
21A
23
23A
23B
30
30C
30T
25
25A
25T
T2
24
24A
24B
24C
29
S
30A
31
22
22A
22B
22C
22D
22E
22F
22G
22H
27
28
P
36
37
38
39

SLIDE SWITCH

BACKGROUND OF THE INVENTION

1. Field of the Invention

This invention relates to slide switches. More particularly, the invention relates to a slide switch having a case member, a slide member movable within a planar range of movement defined in the case member, a conducting device formed between the case member and the slide member, and an elastic member for holding the slide member in a neutral position in which the conducting device becomes non-conducting.

2. Description of the Related Art

One example of slide switches as noted above is disclosed in Japanese laying-open patent publication H10-302576. This slide switch has a slide member movable within a planar range of movement defined in a case member, a conducting device formed between the case member and the slide member, and an elastic member for holding the slide member in a neutral position in which the conducting device becomes non-conducting. The conducting device comprises four elongate armatures formed by a conductive plate to act also as an elastic member. These four elongate armatures are mounted in a rectangular hollow space formed between the case member and the slide member. A conductive plate is disposed in the bottom of the rectangular hollow space for allowing the four elongate armatures to be used commonly. Specifically, each elongate armature is supported at one end thereof by a coiner of the case member, while the armature in a position adjacent the other end acting as a movable contact is pressed against a part of the slide member. As the slide member is moved in the range of movement by a manual operating force, a movable contact touches a fixed contact formed on an inner wall of the case member.

However, the above prior art construction has a large number of parts since the elastic member for maintaining the slide member in the neutral position consists of four elongate members. Further, a process of assembling the switch must include a complex step of pushing the four small elastic elongate members, against the elasticity of the elongate members, and in a way to maintain their correct posture, into the narrow rectangular hollow space between the case member and the slide member. This poses a problem of hampering improved manufacturing efficiency.

Another example of slide switches as noted above is disclosed in Japanese laying-open patent publication H7-235240. This switch has a case member, a slide member movable within a planar range of movement defined in the case member, a conducting device formed between the case member and the slide member, and an elastic member for holding the slide member in a neutral position. In this construction, a hollow, conductive, elastic ring mounted on a boss formed under the slide member acts as both the conducting device and the elastic member. A plurality of insulating projections erected on the bottom of the case member contact the outer surface of the elastic ring to hold the elastic ring in the neutral position. As the slide member is moved in the range of movement by a manual operating force, a peripheral part of the elastic ring is pushed out radially from between the insulating projections, to touch a fixed contact erected on the bottom of the case member.

This construction has a relatively small number of parts, and its assembling operation is considered relatively easy. However, it is technically difficult and involves increased cost to realize an elastic ring having sufficient conductivity, appropriate elasticity and physical durability, and the hollow structure as well.

An object of this invention is to provide a slide switch having a small number of parts, easy to assemble, and relatively inexpensive. Another object of this invention is to realize a slide switch, with a minimum number of parts, for constantly maintaining a slide member in an angular posture about an axis perpendicular to a plane of a range of movement.

A further object of this invention is to realize a slide switch, with a minimum number of parts, capable of detecting a manual operation applied to a slide member along Z-axis perpendicular to a plane of a range of movement in addition to a manual operation applied parallel to the plane of the range of movement.

SUMMARY OF THE INVENTION

The above objects are fulfilled, according to this invention defined in claim 1, by a slide switch comprising a case member, a slide member movable in a planar range of movement defined in the case member, a conducting device formed between the case member and the slide member, and an elastic member for holding the slide member in a neutral position where the conducting device is non-conductive, the elastic member being an integral unit having a holding portion engaged with the slide member, and projecting portions extending from the holding portion along the planar range of movement toward inner walls of the case member, wherein the conducting device includes contacts arranged on the inner walls of the case member, and conductors arranged on the holding portion of the elastic member, and the conductors of the elastic member are movable into contact with the contacts of the case member by an external force for moving the slide member away from the neutral position against a biasing force of the elastic member, and separable from the contacts by the biasing force of the elastic member when the external force is removed.

With the above characteristic construction, the slide switch according to this invention defined in claim 1 has the elastic member formed as an integral unit, and therefore the number of parts is reduced correspondingly. For the same reason, the elastic member may be assembled into the case member with ease. Further, the conducting device is realized by arranging the conductors on the holding portion of the elastic member. This allows the elastic member itself to be formed of an ordinary, inexpensive non-conductive elastomer, hence an advantage of a relatively low manufacturing cost.

The inner walls of the case member and outer surfaces of the slide member may have a common polygonal shape, each of the outer surfaces of the slide member being maintained parallel to an opposed one of the inner walls of the case member, absent the external force, by the biasing force of the elastic member.

With this construction, where, for example, the slide member is made movable from a neutral position in four directions, right and left and up and down, along the planar range of movement to realize four types of switching operation corresponding to the four directions, the slide member is positioned to have the conductors contact the predetermined contacts by virtue of contact between a side wall of the case member and a side wall of the slide member. This is achieved not only when the slide member is operated in the four directions, right and left and up and down, but also when the slide member is operated in a direction between two adjacent directions of the four directions. This assures a reliable switching operation and an agreeable operational feeling.

The inner walls of the case member and the holding portion of the elastic member may form squares as seen in a direction perpendicular to the planar range of movement, the projecting portions of the elastic member extending from respective corners of the square of the holding portion toward respective corners defined by the inner walls of the case member, the contacts may be formed on the four inner walls of the case member, respectively, and the conductors may be formed on the four sides of the holding portion of the elastic member, respectively.

This construction enables a light and swift switching operation since the conductors formed on the holding portion of the elastic member can contact the contacts formed on the inner walls of the case member substantially only by means of deformation of the projecting portions having a small sectional area. Further, the elastic member is prevented from inadvertently rotating inside the case member by engagement between extreme ends of the projecting portions and respective corners defined by the inner walls of the case member. This effectively avoids erroneous switching operations.

The case member may include support portions formed in the respective corners thereof for supporting the projecting portions of the elastic member to maintain the holding portion in a state spaced from a bottom surface of the case member.

This construction provides little chance of friction between the holding portion occupying a central region of the elastic member and the bottom surface of the case member, thereby enabling a light and swift switching operation. At the same time, this construction assures a smooth return to the neutral position of the slide member.

The elastic member includes bend points elastically yieldable even to a slight external force.

This construction furthers the light and swift switching operation.

Each of the projecting portions of the elastic member may have a pair of plate-like members separated by a slit extending radially outwardly from the holding portion, and joined together at extreme ends thereof.

With this construction, a movement of the slide member necessary to execute a single switching operation involves a deformation of only one side of certain projecting portion separated by the slit. Consequently, an external force required to move the slide member is halved, to realize a still lighter switching operation. Further, with this construction, the slide member is movable toward the corners in the case member while forcing its way into the slits. This feature enables two types of switching corresponding to two adjacent directions among the four, right and left and up and down directions.

In the construction noted above, each of the projecting portions may have, formed at an extreme end thereof, a bend point elastically yieldable even to a slight external force.

With this construction, a single switching operation and a simultaneous operation of two types of switching may be carried out with a lighter touch.

In another aspect of the invention, a slide switch, as set forth in claim 8, comprises a case member, a slide member movable in a planar range of movement defined in the case member, a conducting device formed between the case member and the slide member, an elastic member for holding the slide member in a neutral position where the conducting device is non-conductive, the elastic member having a holding portion engaged with the slide member, and projecting portions extending from the holding portion along the planar range of movement toward inner walls of the case member, and a guide mechanism for maintaining the slide member in a fixed angular posture about an axis perpendicular to the planar range of movement regardless of movement of the slide member caused by the external force, wherein the conducting device includes contacts arranged on the inner walls of the case member, and conductors arranged on the holding portion of the elastic member, and the conductors of the elastic member are movable into contact with the contacts of the case member by an external force for moving the slide member away from the neutral position against a biasing force of the elastic member, and separable from the contacts by the biasing force of the elastic member when the external force is removed.

With the above construction, the slide switch according to this invention defined in claim 8, the conducting device is realized by arranging the conductors on the holding portion of the elastic member. This allows the elastic member itself to be formed of an ordinary, inexpensive non-conductive elastomer, hence an advantage of a relatively low manufacturing cost. Further, the guide mechanism acts to maintain the slide member constantly in a fixed angular posture about the axis perpendicular to the planar range of movement. Thus, the elastic member is prevented from inadvertently rotating. Where a control member is disposed outside the case member for receiving a manual operating force directly, and transmitting this force to the slide member, the control member may have indications marked thereon to signify switching directions. Such a switch will perform excellent functions in a satisfactory manner.

In a further aspect of the invention, a slide switch, as set forth in claim 11, comprises a case member, a slide member movable in a planar range of movement defined in the case member, a conducting device formed between the case member and the slide member, an elastic member for holding the slide member in a neutral position where the conducting device is non-conductive, the elastic member having a holding portion engaged with the slide member, and projecting portions extending from the holding portion along the planar range of movement toward inner walls of the case member, and an auxiliary conducting device electrically switchable on and off by an external force applied to the slide member and acting along a Z-axis perpendicular to the planar range of movement, wherein the conducting device includes contacts arranged on the inner walls of the case member, and conductors arranged on the holding portion of the elastic member, and the conductors of the elastic member are movable into contact with the contacts of the case member by the external force for moving the slide member away from the neutral position against a biasing force of the elastic member, and separable from the contacts by the biasing force of the elastic member when the external force is removed.

With the above construction, the slide switch according to this invention defined in claim 11 is capable of detecting a manual operation applied to the slide member along Z-axis perpendicular to the planar range of movement as well as a manual operation applied parallel to the planar range of movement. This slide switch is realized while maintaining a minimum number of parts.

To realize the above construction, the slide switch may, specifically, further comprise an auxiliary elastic member elastically deformable by the external force acting along the Z-axis, wherein the auxiliary conducting device includes a fixed contact formed on a bottom surface of the case member, and a movable contact formed on the auxiliary elastic member for contacting the fixed contact in response to the external force along the Z-axis, and separable from the fixed contact upon removal of the external force acting along the Z-axis.

This construction detects a switching operation only when an operating force is applied to the slide member along Z-axis to elastically deform the auxiliary elastic member. While such an operating force is removed, the contact and movable contact remain separated by the action of the auxiliary elastic member.

The auxiliary elastic member may comprise a dome-shaped member having a concave side opposed to the surface of the case member, and a convex side opposed to the slide member, at least the concave side being formed of a conductive material acting as the movable contact.

With this construction, since the movable contact is formed on the convex side of the dome-shaped member opposed to the slide member, even where the slide member is slidable in contact with the convex side of the dome-shaped member, for example, resistance to the slide member within the planar range of movement may be equalized regardless of the direction of movement.

Further, even when a manual operating force is applied along Z-axis to a position slightly displaced from the center of the dome-shaped member, the central position of the dome-shaped member is elastically deformed to produce a conducting state. As a result, a simultaneous detection may be made of a switch-on state based an operation of the slide member in the planar range of movement, and a switch-on state based an operation of the slide member along Z-axis.

The slide switch may further comprise a control member supported outside the case member for receiving a manual operating force, the control member and the slide member being connected to each other whereby the manual operating force received by the control member is transmitted to the slide member.

With this construction in which the control member connected to the slide member as noted above, when the control member is operated in a sliding direction, the elastic member is deformed to enable an electrical detection of this operation. When the control member operated in the direction of depression, the auxiliary elastic member is deformed to enable an electrical detection of the operation along Z-axis. As a result, while allowing a smooth operation of the control member disposed outside the case member, a direction of operation may be electrically detected reliably.

The slide switch may further comprise a guide mechanism for maintaining the slide member in a fixed angular posture about an axis perpendicular to the planar range of movement regardless of movement of the slide member caused by the external force, wherein the guide mechanism includes an intermediate slide member disposed between the slide member and a lid covering an upper surface of the case member; and a guide member disposed between the slide member and the auxiliary elastic member; a first guide being formed between the slide member and the intermediate slide member for guiding the intermediate slide member to move along an X-axis relative to the lid, and a second guide being formed between the lid and the intermediate slide member for guiding the slide member to move along an a Y-axis intersecting the X-axis relative to the intermediate slide member; the guide member supporting the slide member movable within the planar range of movement, and deformable along a Z-axis perpendicular to the planar range of movement.

With this construction, when the slide member is operated, the guide mechanism causes the slide member to make a parallel movement. This eliminates the inconvenience of the slide member inadvertently rotating within the planar range of movement. Moreover, the slide member is guided by the guide member to move smoothly within the planar range of movement. Even where a depressing force acts to displace the slide member along Z-axis, the guide member is deformed to allow movement of the slide member. As a result, where the slide member has a control member in the form of a keytop, for example, and the control member has indications marked thereon showing switching directions, there is no possibility of errors occurring with the directions indicated. A depressing operation may be carried out smoothly despite the provision of the guide mechanism.

Alternatively, the slide switch may further comprise a guide mechanism for maintaining the slide member in a fixed angular posture about an axis perpendicular to the planar range of movement regardless of movement of the slide member caused by the external force; wherein the guide mechanism includes an intermediate slide member disposed between the slide member and the auxiliary elastic member; and a guide member disposed between the intermediate slide member and the auxiliary elastic member; a first guide being formed between the guide member and the intermediate slide member for guiding the intermediate slide member to move along an X-axis relative to the case member, and a second guide being formed between the slide member and the intermediate slide member for guiding the slide member to move along an a Y-axis intersecting the X-axis relative to the intermediate slide member; the guide member supporting the slide member movable within the planar range of movement, and deformable along a Z-axis perpendicular to the planar range of movement.

With this construction, when the slide member is operated, the guide mechanism causes the slide member to make a parallel movement. This eliminates the inconvenience of the slide member inadvertently rotating within the planar range of movement. Moreover, the slide member is guided by the guide member to move smoothly within the planar range of movement. Even where a depressing force acts to displace the slide member along Z-axis, the guide member is deformed to allow movement of the slide member. As a result, where the slide member has a control member in the form of a keytop, for example, and the control member has indications marked thereon showing switching directions, there is no possibility of errors occurring with the directions indicated. A depressing operation may be carried out smoothly despite the provision of the guide mechanism.

DESCRIPTION OF THE PREFERRED EMBODIMENTS

Embodiments of this invention will be described hereinafter with reference to the drawings.

First Embodiment

Figure 1:
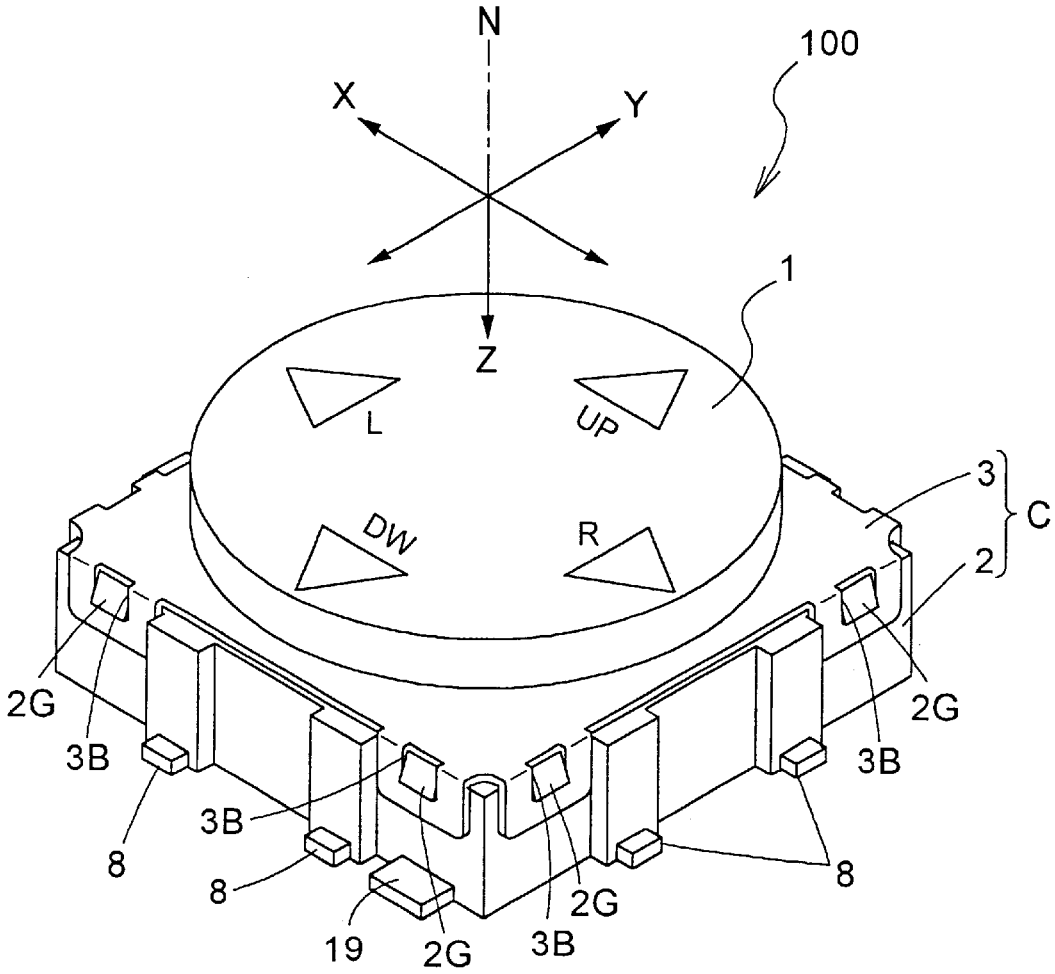
FIG. 1 is a perspective view of a slide switch in a first embodiment of the invention.

A slide switch 100 shown in FIG. 1 has a keytop 1 (one example of control member) acting as a manually operable member. The keytop 1, when not operated, is maintained in a neutral position N (non-operated position). The keytop 1 is operable, from the neutral position N, in X-direction, in Y-direction perpendicular to X-direction, in varied directions combining X- and Y-directions, and in Z-direction (direction of depression) perpendicular to these directions. Such operations of the keytop 1 are electrically detected. This slide switch 100 may be used with a remote controller of a household electric appliance, a mobile phone, a controller of a game machine, a dashboard of a car, and so on.

The slide switch 100 has the keytop 1 and a case member C. A panel of a household electric appliance or the like may be disposed between the keytop 1 and case member C.

Figure 2:
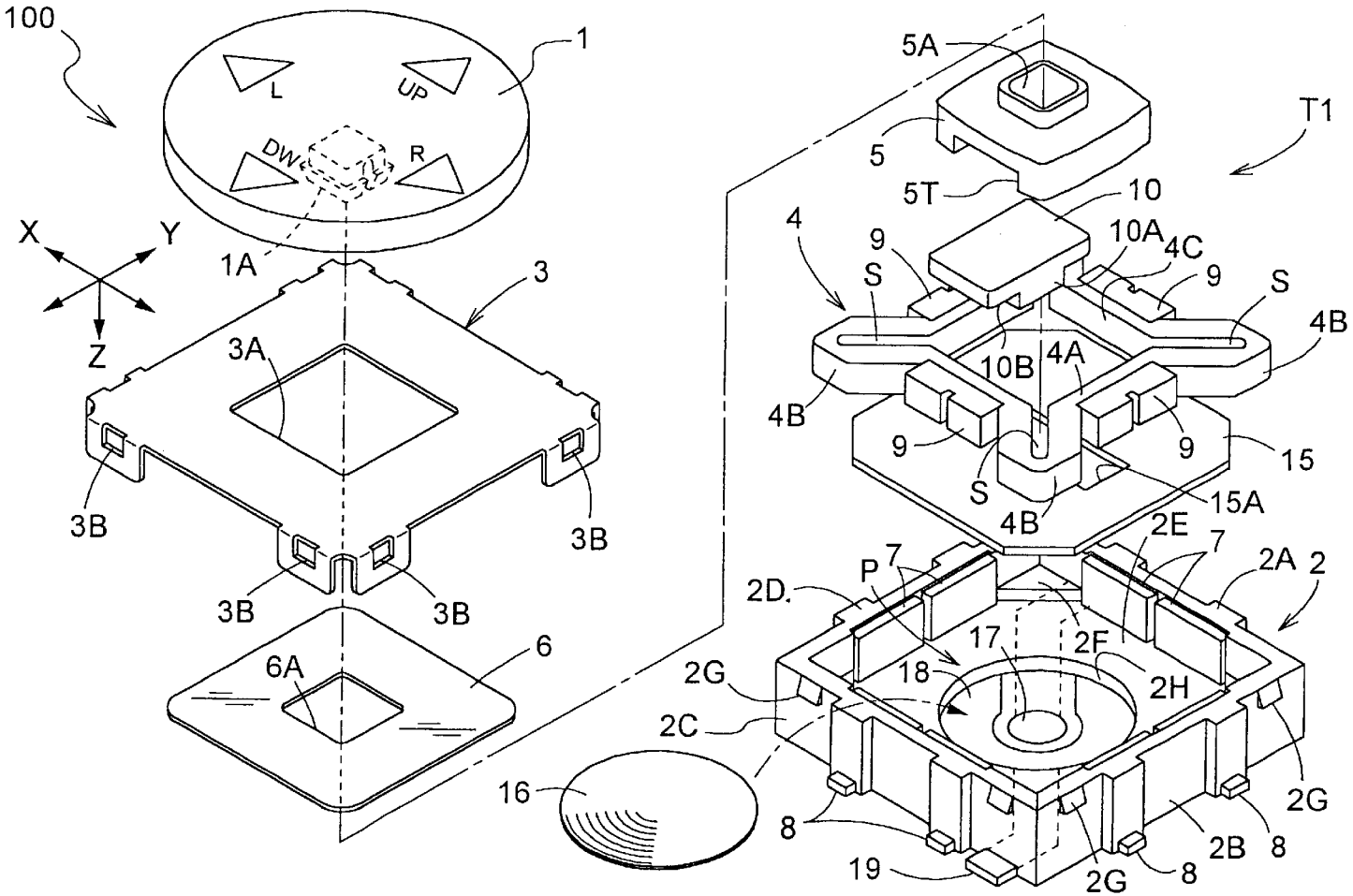
FIG. 2 is an exploded perspective view of the slide switch shown in FIG. 1.
Figure 3:
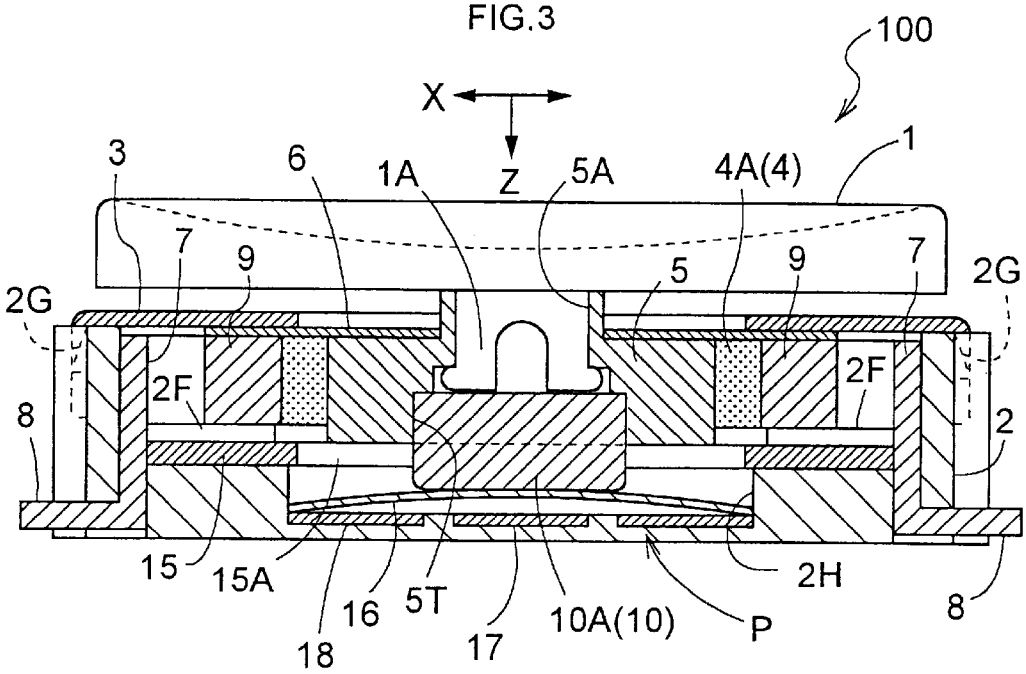
FIG. 3 is a side view in vertical section of the slide switch of FIG. 1.

As shown in FIGS. 1 through 4 and FIG. 7, the case member C includes a main case body 2 disposed in a lower position in FIGS. 1 through 3, and a lid 3 for covering an upper opening of main case body 2 in FIGS. 1 through 3. The main case body 2 contains an elastic member 4, a slide member 5, a guide plate 15 (one example of guide member) and an auxiliary elastic member 16. A sheet 6 is disposed to cover an area over these components. The keytop 1 is disposed above the lid 3.

Figure 4:
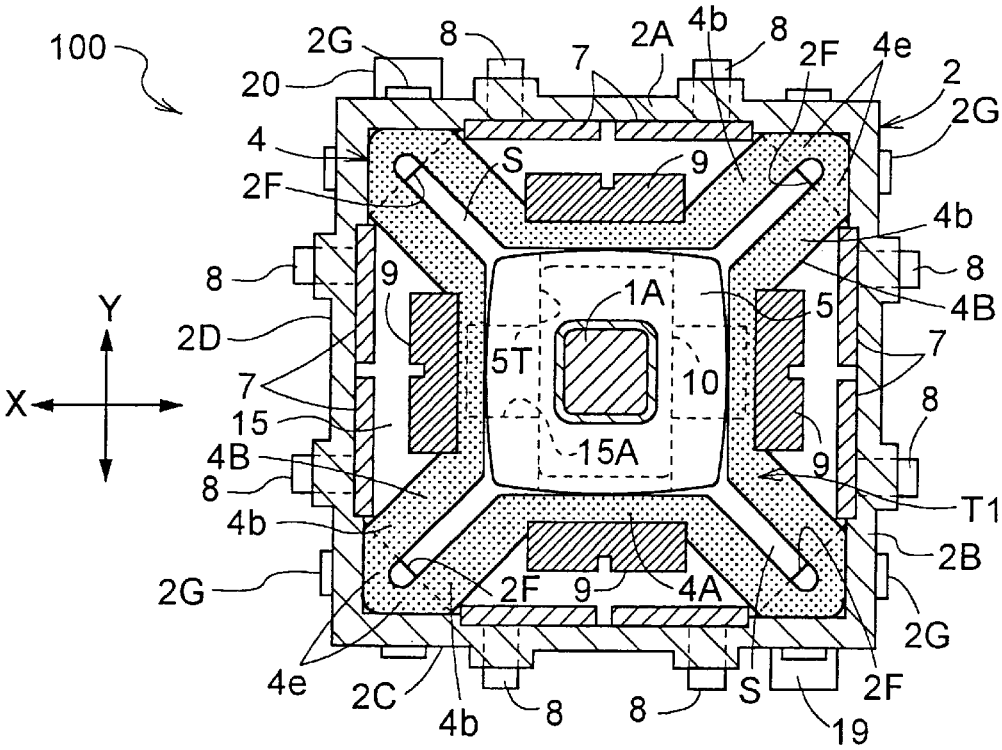
FIG. 4 is a cross-sectional plan view of the slide switch shown in FIG. 1.

The slide member 5 is slidable in a planar range of movement corresponding to the plane of FIG. 4. The main case body 2 is formed of a resin material such as ABS resin or PPS resin to define four side walls 2A, 2B, 2C and 2D and a bottom wall 2E. The main case body 2 forms a square as seen in a direction perpendicular to the plane of the range of movement, and opens upward. The bottom wall 2E of main case body 2 includes, adjacent the four corners defined with the side walls 2A, 2B, 2C and 2D, supports 2F elevated from the level of a central region thereof. Each of the four side walls 2A, 2B, 2C and 2D forming a square has a pair of contacts 7 (one example of conducting device) formed of a good conductor such as a copper alloy. Conducting terminals 8 formed integral with these contacts 7 project from outer surfaces of the main case body 2.

The bottom wall 2E defines a circular recess 2H centrally thereof. A first fixed contact 17 is disposed in an inner central position of the recess 2H. The recess 2H further includes a ring-like second fixed contact 18 formed around the first fixed contact 17. The first fixed contact 17 and second fixed contact 18 are formed of a good conductor such as a copper alloy. A second terminal 19 connected to the second fixed contact 18, and a first terminal 20 connected to the first fixed contact 17, project from the outer surfaces of main case body 2. In addition, the auxiliary elastic member 16 having a dome shape made by processing a metal disc of a good conductor such as a copper alloy is fitted in the recess 2H, with a bulging face directed toward the opening of main case body 2 (upward in the drawings). The auxiliary elastic member 16 has an outer periphery thereof maintained in contact with the second fixed contact 18, while the central portion of the auxiliary elastic member 16 is maintained out of contact with the first fixed contact 17. The auxiliary elastic member 16 has a movable contact 16*a* formed on a lower surface thereof, which, in combination with the first fixed contact 17 and the second fixed contact 18, constitute a contact unit P.

When the keytop 1 is depressed toward the bottom wall 2E (in Z-direction) by a manual operating force, the auxiliary elastic member 16 is elastically deformed to allow the central position thereof to move into contact with the first fixed contact 17. This contact connects the first terminal 20 and second terminal 19, whereby the operation for depressing the keytop 1 is electrically detected. In order that the user may feel a click when the auxiliary elastic member 16 is depressed, the auxiliary elastic member 16 is formed of a material that has a biasing force for restoration lowering to a great extent when its central portion under pressure deforms beyond a predetermined amount in the depressing direction.

The main case body 2 has a plurality of engaging projections 2G formed on outer surfaces of the side walls 2A, 2B, 2C and 2D. On the other hand, the lid 3 is formed of metal such as aluminum or steel or plastic such as PET, to have a generally square configuration in the form of a thin plate having a size to cover the opening of the main case body 2. The lid 3 has an opening 3A formed centrally thereof, and lugs formed adjacent the corners and defining engaging openings 3B for receiving the engaging projections 2G of the main case body 2.

The elastic member 4 is formed of an elastomeric material elastically deformable and electrically nonconductive, such as silicon rubber, ethylene propylene rubber (EPDM) and nitrile rubber (NBR). This elastic member 4 is formed to have an integral construction including a holding portion 4A in the form of a hollow square frame smaller than the main case body 2, and four projecting portions 4B extending outwardly from the corners of the holding portion 4A toward the inner wall of the main case body 2. Each projecting portion 4B is formed of a pair of plate-like members separated by a slit S extending radially outwardly from the holding portion 4A, and joined at extreme ends thereof. The slit S is continuous with the opening 4C of the holding portion 4A. The holding portion 4A has, formed integral with the four side surfaces thereof opposed to the side walls 2A, 2B, 2C and 2D of the main case body 2, conductors 9 (one example of the other conducting device) formed of a resin base containing a carbon material, for example.

In other words, the elastic member 4 includes a four-sided holding portion 4A extending circumferentially of the rectangular slide member 5, and pairs of projecting portions 4*b* extending from opposite ends of the holding portion 4A toward the four corners of the inner walls of main case body 2. A slit S is extends between each pair of projecting portions 4*b*. Each pair of projecting portions 4*b* have extreme ends thereof connected together. Each pair of projecting portions 4*b* includes, adjacent the extreme ends thereof, a pair of bend points 4*e* having a smaller sectional area than the other parts and elastically yieldable even to a slight external force. The elastic member 4 is placed above the guide plate 15, with extreme end regions of the projecting portions 4B placed on the four supports 2F. A greater part of the elastic member 4, particularly the entire holding portion 4A is freely movable within the planar range of movement formed in the main case body 2, without contacting the bottom wall 2E of the main case body 2 and the guide plate 15.

Figure 8:
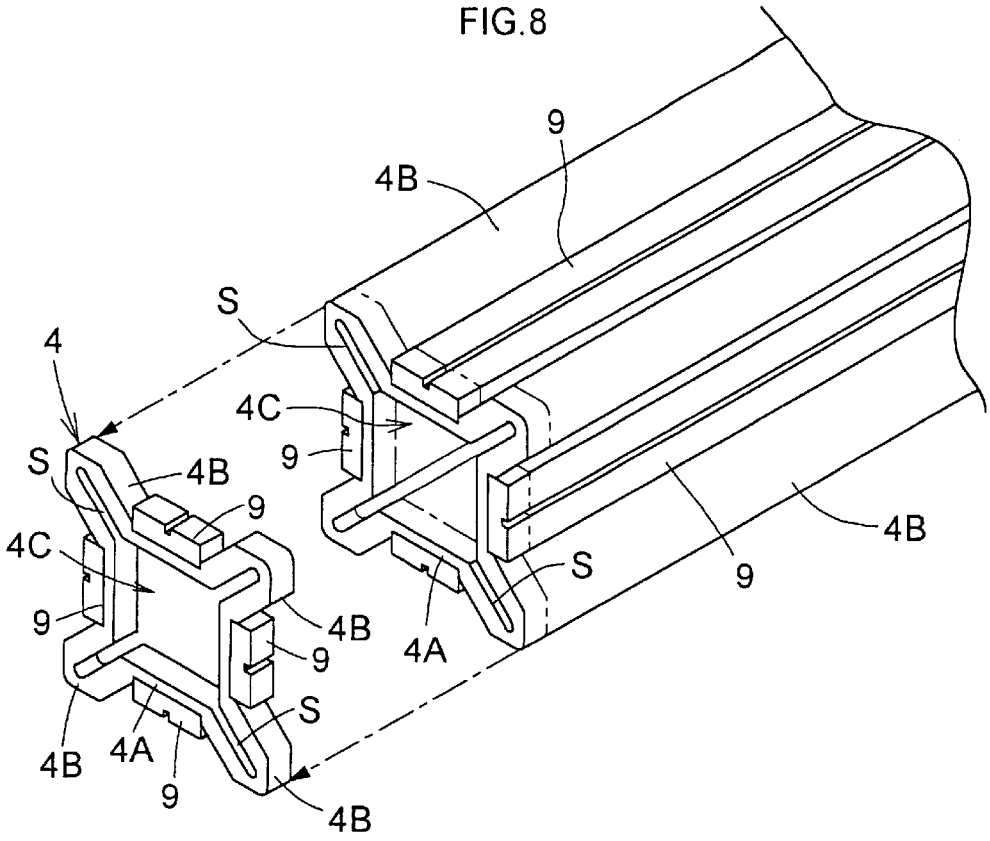
FIG. 8 is a perspective view illustrating a mode of manufacturing an elastic member.
Figure 9:
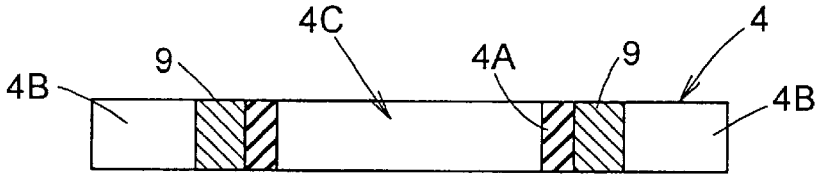
FIG. 9 is a sectional view of the elastic member.
Figure 11:
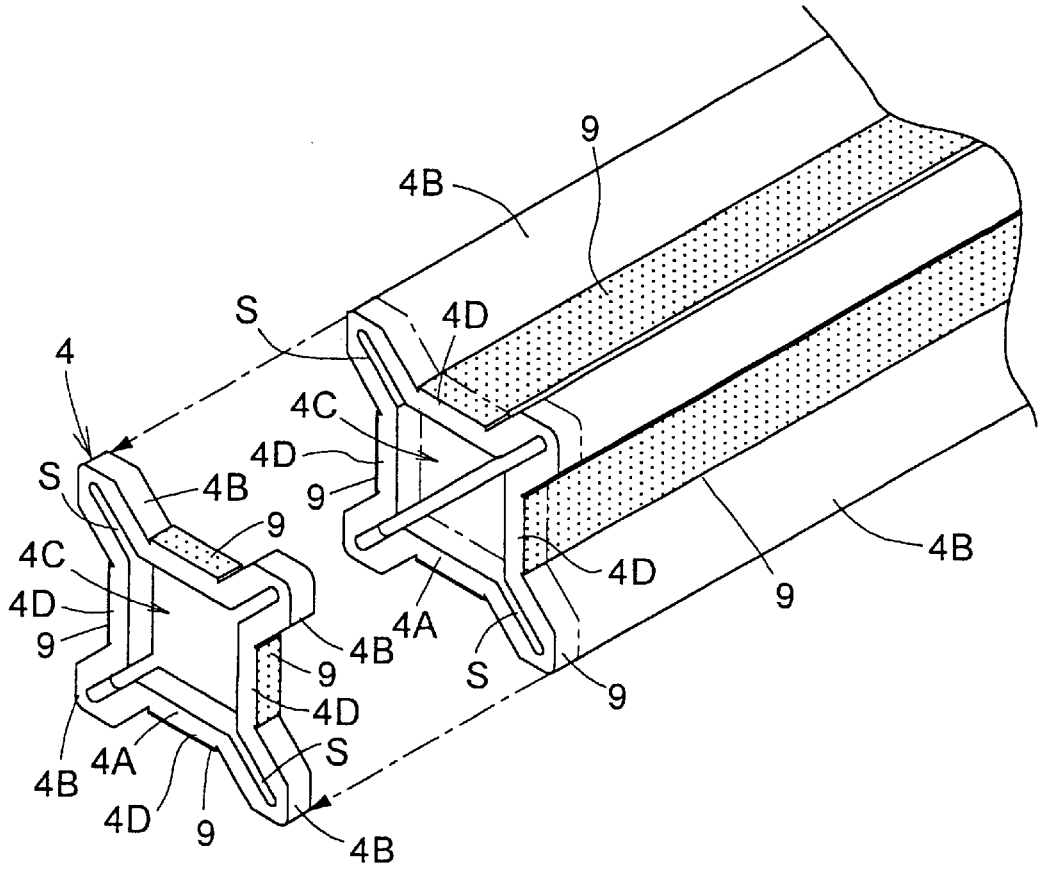
FIG. 11 is a perspective view illustrating a different mode of manufacturing an elastic member.
Figure 12:
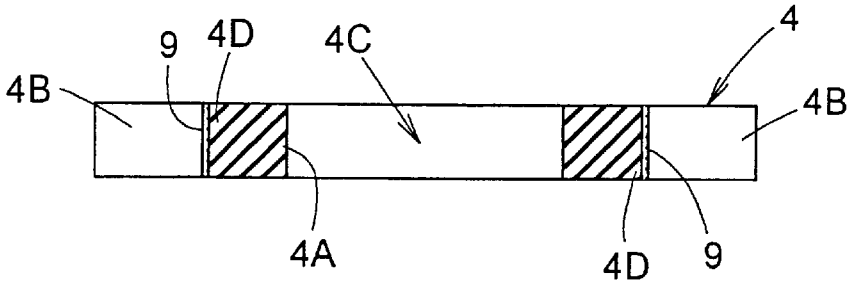
FIG. 12 is a sectional view of a modified elastic member.

The elastic member 4 used with the slide switch 100, in particular, is manufactured by extruding molding, as shown in FIGS. 8 and 9, to form the holding portion 4A and projecting portions 4B together as a tubular unit. The strap-like conductors 9 may be fixedly bonded to the outer surfaces of the holding portion 4A of this molded product. The strap-like conductors 9 may be inserted when extruding the holding portion 4A and projecting portions 4B as an integral formation. Alternatively, as shown in FIGS. 11 and 12, when extruding the holding portion 4A and projecting portions 4B, protrusions 4D may be formed on the four sides of the holding portion 4A to be opposed to the side walls 2A, 2B, 2C and 2D of main case body 2, and layers of the conductors 9 may be formed by padding technique to apply a conductive ink and conductive paint to outer surfaces of these protrusions 4D, thereby forming a tubular product with strap-like conductors 9 formed integrally therewith. The tubular product is cut to a thickness for accommodation in the main case body 2.

Figure 10:
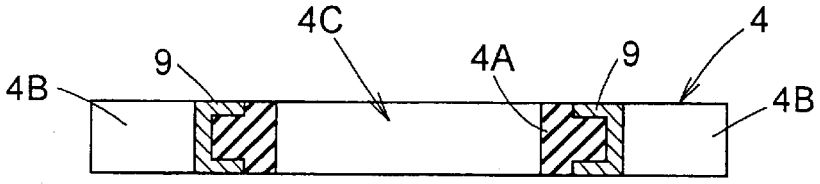
FIG. 10 is a sectional view of a modified elastic member.

It is also possible to manufacture the elastic member 4 one by one by using a metal die. In this case, as shown in FIG. 10, the conductors 9 formed of a good conductor such as a copper alloy may be inserted and integrated.

The guide plate 15 is placed in tight contact with the bottom wall 2E of the main case body 2. The guide plate 15 defines a guide bore 15A extending in X-direction and movably supporting an intermediate slide member 10. The slide member 5 is supported by the intermediate slide member 10 to be movable in the direction (Y-direction) perpendicular to the direction of movement of the intermediate slide member 10. The guide plate 15 defining the guide bore 15A, the intermediate slide member 10, and a system for sidably supporting the slide member 5 on the intermediate slide member 10, constitute a guide mechanism T1. The slide member 5 is formed of a resin material to have a shape fitting tight in the opening 4C of the holding portion 4A of the elastic member 4. The slide member 5 has an engaging recess 5A formed centrally of an upper surface thereof for receiving and connecting a shank 1A of the keytop 1.

The guide mechanism T1 will now be described in detail. The guide plate 15 has a size for fitting in the main case body 2 in tight contact with the bottom wall 2E, and is supported in the main case body 2 not to be rotatable relative thereto. The guide plate 15 is formed, for example, of an insulating plastic material elastically deformable in the direction of thickness. The intermediate slide member 10 has a lower surface thereof acting as a sliding contact surface 15B for sidable contact with the upper surface of the guide plate 15. A projection 10A (one example of the other first guide) is formed on the sliding contact surface 15B for engaging the guide bore 15A (one example of the one first guide). The slide member 5 has a guide groove 5T (one example of the other second guide) formed in a lower surface thereof for receiving the intermediate slide member 10 (one example of the one second guide). Thus, the intermediate slide member 10 is sidable longitudinally of the guide bore 15A (in X-direction) of the guide plate 15. The slide member 5 is sidable relative to the intermediate slide member 10, in the direction (Y-direction) perpendicular to the sliding direction of the intermediate slide member 10. Consequently, the slide member 5 is sidable in X-direction, Y-direction, and composite directions combining X- and Y-directions, within the "planar range of movement" defined in the main case body 2, without changing its posture (i.e. without rotating) relative to the main case body 2.

The slide member 5, having a construction simply fitted in the holding portion 4A of the elastic member 4, is movable in the direction (Z-direction) perpendicular to the sliding directions (X–Y directions) within the "planar range of movement". The guide plate 15 and auxiliary elastic member 16 are arranged in the stated order from the slide member 5 toward the bottom wall 2E of the main case body 2. Thus, when the keytop 1 is depressed toward the main case body 2, the auxiliary elastic member 16 is elastically deformed, while elastic deforming the guide plate 15, whereby the movable contact 16*a* at the center of the auxiliary elastic member 16 is placed in contact with the first fixed contact 17. The projection 10A extends from the lower surface of intermediate slide member 10 to a large extent below the guide plate 15, so that auxiliary elastic member 16 in particular may elastically deform well when a depressing force is applied to the keytop 1 in neutral position in X–Y directions.

As shown in FIGS. 2 and 3, the sheet 6 has a small friction factor and excellent sliding characteristic, and has a size for fitting in the main case body 2. The sheet 6 defines a square through hole 6A smaller than the slide member 5 as seen in the direction perpendicular to the sliding directions of the slide member 5.

With each component constructed as described above, when assembling this slide switch 100, the auxiliary elastic member 16 is set in the main case body 2 already having the contacts 7 and the first and second contacts 17 and 18, and then the guide plate 15 is set in place. The intermediate slide member 10 is set to have the projection 10A extend through the guide bore 15A of the guide plate 15. The slide member 5 is set in place, with the intermediate slide member 10 fitted in the guide groove 5T formed in the lower surface. The elastic member 4 is set in position to receive the slide member 5 in the holding portion 4C, and the sheet 6 is placed over the upper surface. Finally, the lid 3 is pressed toward the main case body 2. This pressing operation causes the engaging opening 3B to engage the plurality of engaging projections 2G of the main case body 2. As a result, the lid 3 is secured to the main case body 2. Thereafter the shank 1A of the keytop 1 is inserted from above through the opening 3A of lid 3 and the opening 6A of sheet 6 to fit into the engaging bore 5A of slide member 5, to complete the slide switch 100.

With the slide switch 100 assembled as described above, the keytop 1, when not operated, lies in neutral position N in X–Y directions, and the contact unit P remains non-conductive. In the interior, as shown in FIG. 4, the slide member 5 is maintained at the center of the main case body 2 by the biasing force of the elastic member 4. The contacts 7 of the main case body 2 are separated from the conductors 9 of the elastic member 4. Thus, every contact 7 remains isolated from the corresponding conductor 9.

Figure 5:
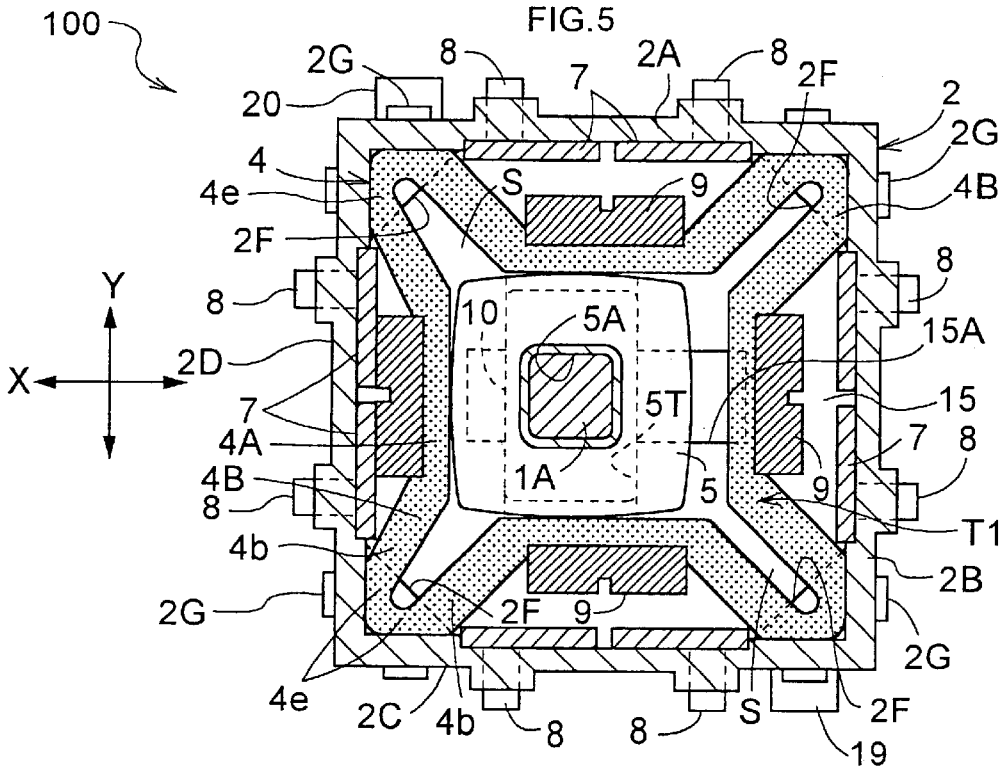
FIG. 5 is a cross-sectional plan view of the slide switch with an operating force applied to a slide member.

Next, when an external force is applied to the keytop 1 in a direction perpendicular to the side wall 2A, 2B, 2C or 2D (i.e. in a direction along either X-direction or Y-direction), e.g. toward the left side wall 2D in FIG. 5, the slide member 5 and intermediate slide member 10 move along the guide bore 15A The side of the holding portion 4A of elastic member 4 downstream in the direction of operation is displaced toward the side wall 2D (since the projection portions 4*b* on the left side of the elastic member 4 undergo an elastic deformation, particularly at the bend points 4*e*). The conductor 9 of the elastic member 4 thereby contacts the pair of contacts 7 on this side wall 2D to render the pair of contacts 7 conductive. The above displacement of the elastic member 4 expands the slits S of the two projecting portions 4B at opposite ends of that side of the holding portion 4. Thus, the projecting portions 4B allow the displacement while exerting an elastic biasing force on the slide member 5 in a restoring direction.

Figure 6:
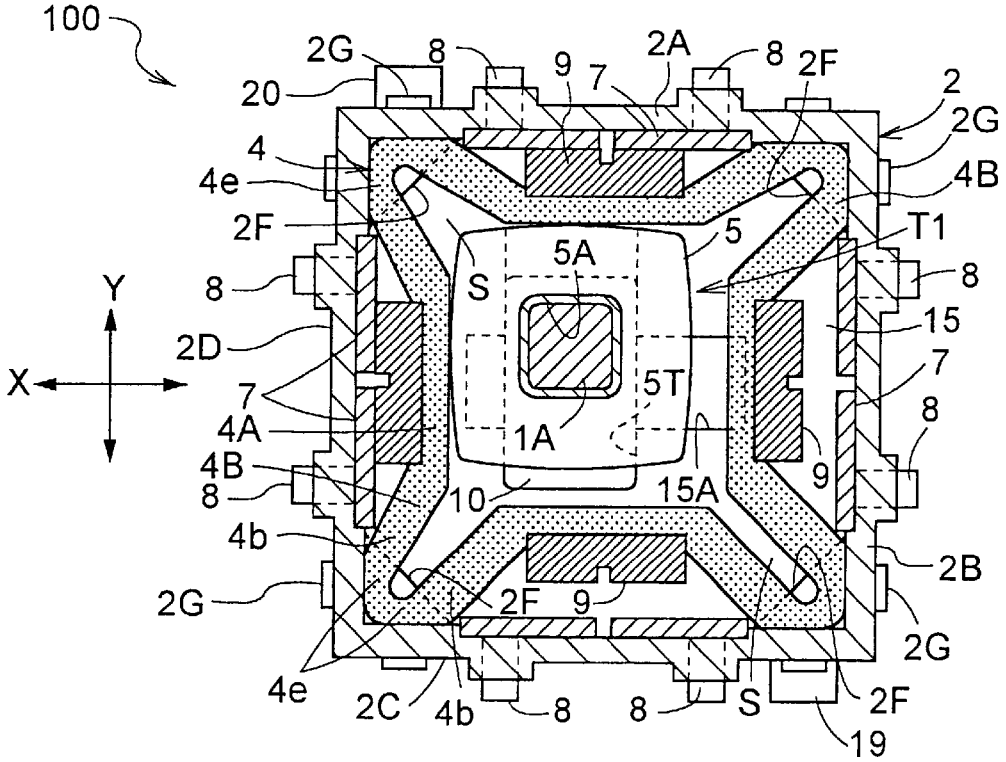
FIG. 6 is a cross-sectional plan view of the slide switch with a different operating force applied to the slide member.
Figure 7:
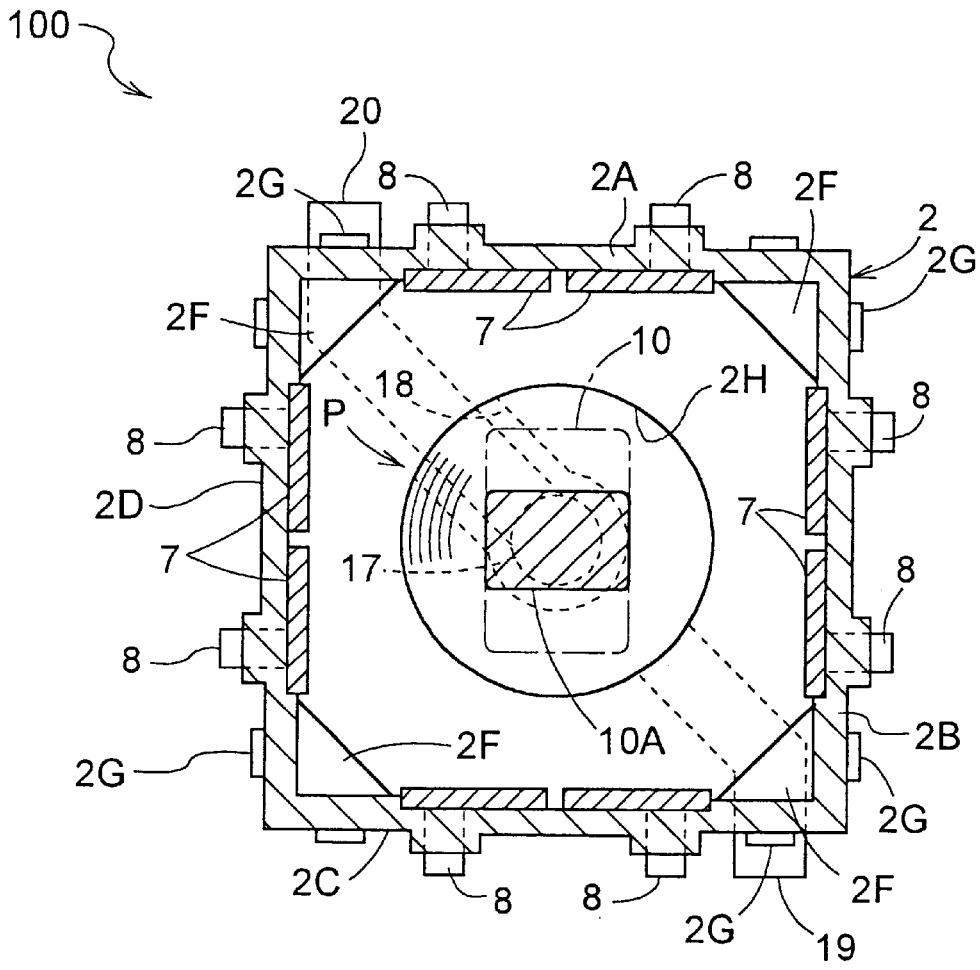
FIG. 7 is a cross-sectional plan view showing the bottom of a main case body of the slide switch shown in FIG. 1.

When an external force is applied to the keytop 1 in an oblique direction toward a comer of the main case body 2, e.g. in a direction between the upper side wall 2A and left side wall 2D in FIG. 6, the intermediate slide member 10 moves along the guide bore 15A, and at the same time the slide member 5 moves by means of the guide groove 5T along the intermediate slide member 10. The slide member 5 then forces into the upper left slit S. The two sides of the holding portion 4A of elastic member 4 downstream in the direction of operation are simultaneously displaced toward the corresponding side walls 2A and 2D. The two conductors 9 of the elastic member 4 thereby simultaneously contact the pairs of contacts 7 on the side walls 2A and 2D to render the pair of contacts 7 conductive. The above displacement of the elastic member 4 expands the slit S of the projecting portion 4B downstream in the direction of operation, to allow the forced entry of the slide member 5. The slits S of the two projecting portions 4B at opposite sides of the expanding slit S also expand. Thus, the projecting portions 4B allow the displacement while exerting an elastic biasing force on the slide member 5 in a restoring direction.

Further, when the keytop 1 is not depressed in Z-direction, as shown in FIG. 3, the movable contact 16*a* of the auxiliary elastic member 16 which is par of the contact unit P remains separated from the first fixed contact 17. When the keytop 1 lying in neutral position N in X–Y directions is depressed in Z-direction toward the main case body 2, the guide plate 15 is elastically deformed to apply a pressing force to the auxiliary elastic member 16 from the projection 10A on the lower surface of the intermediate slide member 10. The movable contact 16*a* of the auxiliary elastic member 16 is elastically displaced into contact with the first fixed contact 17. As a result, this operation is electrically detected. When this depressing force is removed, the contact between the auxiliary elastic member 16 and the first fixed contact 17 is canceled by the restoring force of the auxiliary elastic member 16, and the keytop 1 is restored in the original position.

As described above, when the keytop 1 is operated in one of X–Y directions, the slide member 5 supporting the keytop 1 make a parallel movement under the action of the guide mechanism T1, without changing an angular posture relative to the main case body 2. Consequently, as shown in FIG. 1, the keytop 1 may have such characters as "UP", "DW", "R" and "L" correctly indicating the directions of operation without deviation.

In this embodiment, the contact unit P is constructed for detecting an operation particularly when the keytop 1 is depressed from the neutral position N. The contact unit P of this invention may be adapted to detect also an operation to depress the keytop 1 from any position, other than the neutral position N, in X–Y directions.

This invention may be implemented not only in the foregoing embodiment but in the following embodiments also. (In the following embodiments, like reference numerals or signs will be used to identify like parts with respect to the first embodiment.)

Second Embodiment

Figure 13:
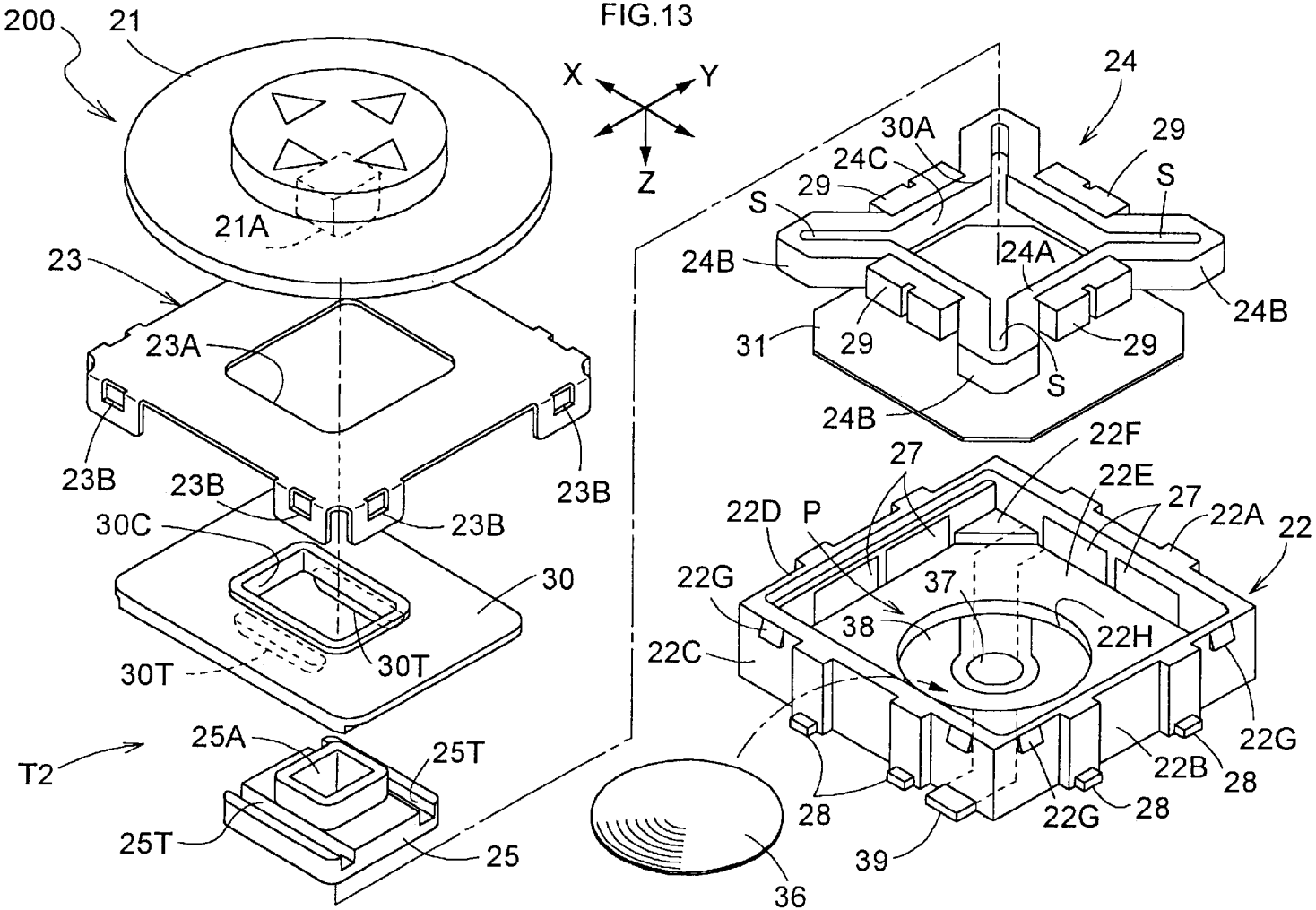
FIG. 13 is an exploded perspective view of a slide switch in a second embodiment.
Figure 14:
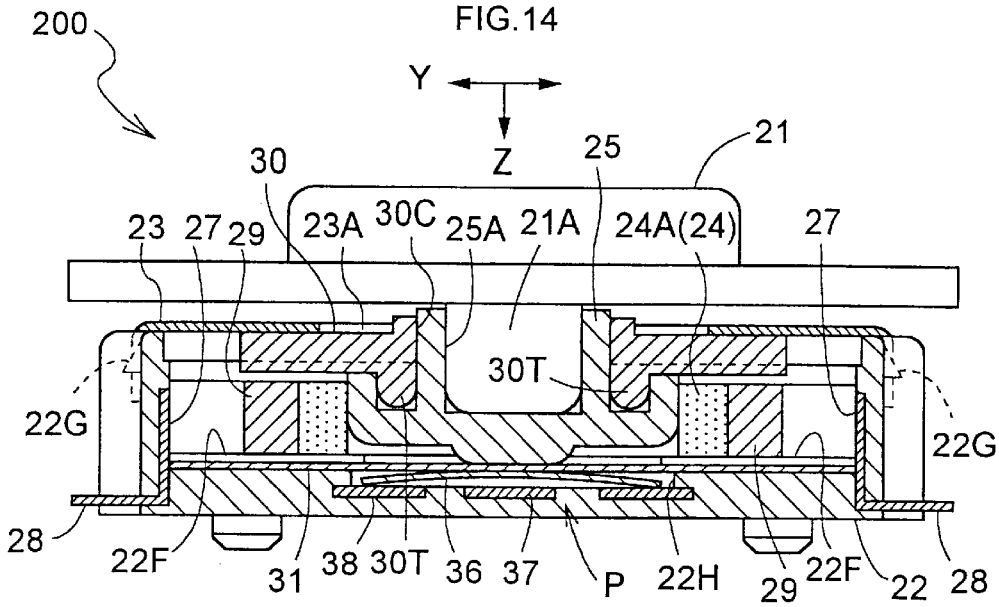
FIG. 14 is a side view in vertical section of the slide switch shown in FIG. 13.
Figure 15:
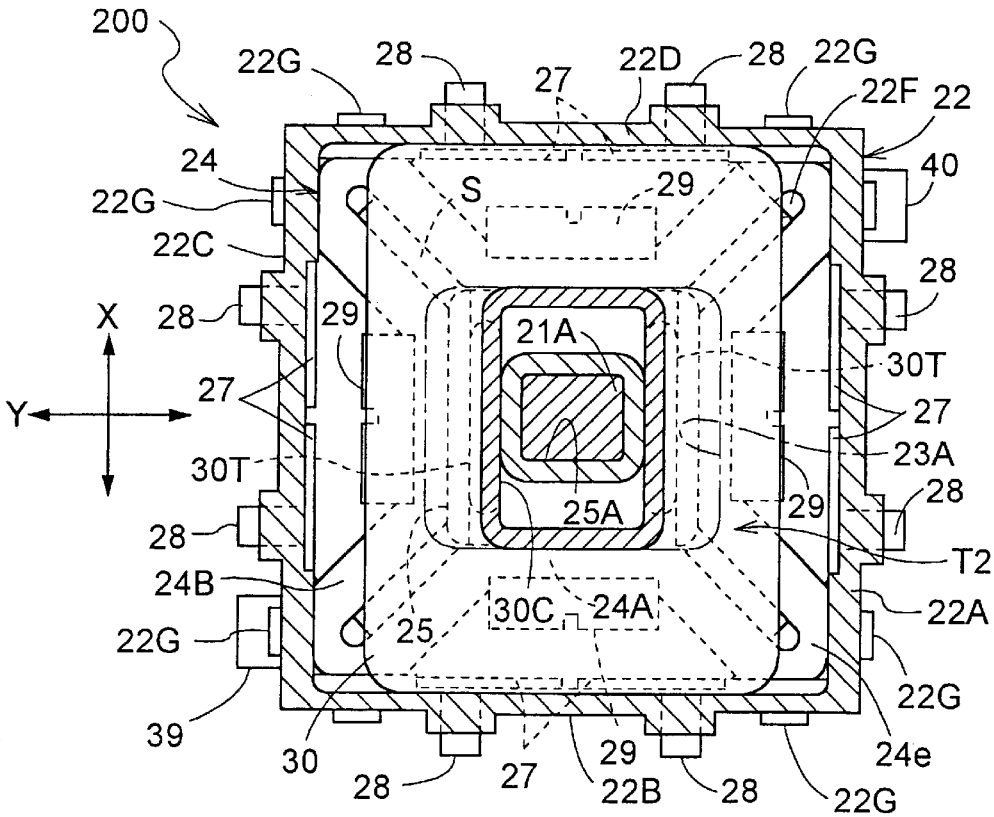
FIG. 15 is a plan view of a main case body of the slide switch shown in FIG. 13.

A slide switch 200 shown in FIGS. 13, 14 and 15 has a main case body 22, a lid 23 defining a guide bore 23A, and an intermediate slide member 30 disposed under the lid 3. The intermediate slide member 30 defines an opening 30C. The opening 30C has a projecting edge (one example of the one second guide) to be guided in Y-direction by the guide bore 23A of the lid 23 (one example of the other second guide). The intermediate slide member 30 has a pair of guides 30T (one example of the one first guide) projecting from the lower surface thereof. A slide member 25 disposed under the intermediate slide member 30 has a guide groove 25T (one example of the other first guide) for receiving the pair of guides 30T, so that the slide member 25 is guided in X-direction perpendicular to X-direction relative to the intermediate slide member 30. The slide member 25 has an opening 25A for receiving a shank 21A of a keytop 21. An insulating plastic sheet 31 is fixedly applied to the bottom wall 22E. The plastic sheet 31 supports the slide member 25 in sliding contact, so that the slide member 25 is freely movable within the "planar range of movement" in the main case body 22. The guide bore 23A of the lid 23, the opening edge of the intermediate slide member 30, the guides 30T of the intermediate slide member 30, the guide groove 25T of the slide member 25, and the plastic sheet 31, constitute a guide mechanism T2 for guiding the slide member 25 of the slide switch 200, without rotating about an axis perpendicular to the "planar range of movement".

The opening 25A of the slide member 25 is shaped square not to be rotatable relative to the shank 21A of the keytop 21 fitted therein. This opening 25A is a bottomed hole, and the bottom surface includes a projection slightly projecting downward as seen in FIG. 14. When the keytop 21 is depressed (in Z-direction), the projection applies a pressing force through the plastic sheet 31 to the contact unit P.

The second embodiment is different from the first embodiment only in the construction of guide mechanism T2, and the plastic sheet 31 placed over the contact unit P, the other aspects being the same as in the first embodiment.

That is, the main case body 22 has side walls 22A, 22B, 22C and 22D and a bottom wall 22E, and includes, adjacent the four corners, supports 22F elevated from the level of a central region thereof. Each of the side walls 22A, 22B, 22C and 22D has a pair of contacts 27 formed on an inner surface thereof, and conducting terminals 28 formed integral with these contacts 27 and projecting from outer surfaces of the main case body 22.

The bottom wall 22E defines a circular recess 22H centrally thereof. A first fixed contact 37 is disposed in an inner central position of the recess 22H. The recess 22H further includes a ring-like second fixed contact 38 formed around the first fixed contact 37. The first fixed contact 37 and second fixed contact 38 are formed of a good conductor such as a copper alloy. A second terminal 39 connected to the second fixed contact 38, and a first terminal 40 connected to the first fixed contact 37, project from the outer surfaces of main case body 22. In addition, an auxiliary elastic member 36 having a dome shape made by processing a metal disc of a good conductor such as a copper alloy is fitted in the recess 22H, with a bulging face directed toward the opening of main case body 22 (upward in FIG. 14). The auxiliary elastic member 36 has an outer periphery thereof maintained in contact with the second fixed contact 38, while the central portion thereof is maintained out of contact with the first fixed contact 37. The auxiliary elastic member 36, the first fixed contact 37 and the second fixed contact 38, constitute the contact unit P.

The main case body 22 has a plurality of engaging projections 22G formed on outer surfaces of the four side walls 22A, 22B, 22C and 22D. The lid 23 is formed of metal such as aluminum or steel or plastic such as PET, to have a generally square configuration in the form of a thin plate having a size to cover the opening of the main case body 22. The lid 23 has lugs formed adjacent the corners and defining engaging openings 23B for receiving the engaging projections 22G of the main case body 22.

A biasing member 24 includes a holding portion 24A in the form of a hollow square frame, and four projecting portions 24B extending outwardly from the corners of the holding portion 24A. Each projecting portion 4B defines a slit S continuous with the opening 24C of the holding portion 24A. The holding portion 24A has, formed integral with the four side surfaces thereof opposed to the side walls 22A, 22B, 22C and 22D of the main case body 22, conductors 29 formed of a resin base containing a carbon material.

With the above construction, when the keytop 21 lying in neutral position N is depressed in Z-direction, the slide member 25 moves downward with the keytop 21. The projection formed on the lower surface of the slide member 25 applied a pressure to deform the plastic sheet 31 and elastically deform the central position of auxiliary elastic member 36 downward. The first fixed contact 37 and second fixed contact 38 are thereby made conductive, thereby allowing this operation to be electrically detected.

As a modification of this embodiment, the auxiliary elastic member 36 may be made rectangular or linear instead of circular. This construction will allow a simplification of the contact unit P.

As another modification of this embodiment, the contact unit P may include a contact switchable from conductive state to non-conductive state when the keytop 21 is depressed. This construction may allow an inverter to be dispensed with where the slide switch is used with a logic circuit.

Third Embodiment

Figure 16:
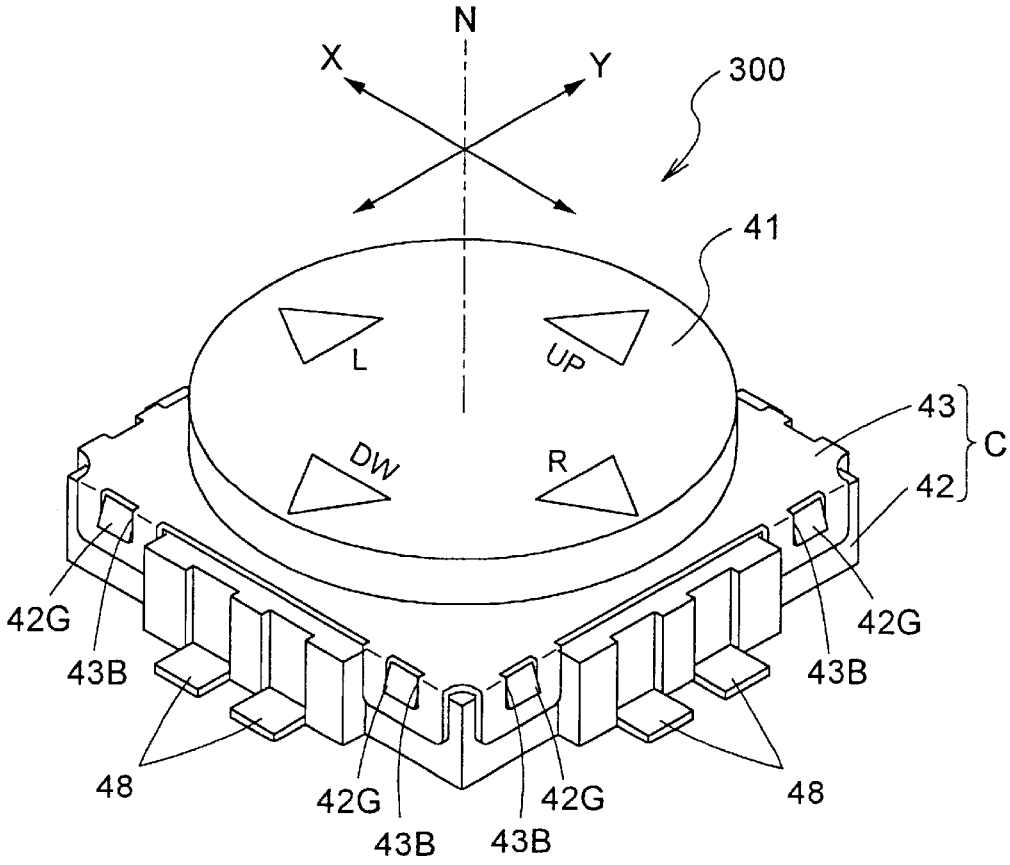
FIG. 16 is a perspective view of a slide switch in a third embodiment.

The slide switch 300 shown in FIG. 16 as a third embodiment does not include the mechanism, as described in the first and second embodiments, for detecting an operation to depress the keytop 1 in Z-direction.

This slide switch 300 may also be used with a remote controller of a household electric appliance, a mobile phone, a controller of a game machine, a dashboard of a car, and so on. The slide switch 300 includes a keytop 41 and a case member 40C as main components thereof. A panel of a household electric appliance, for example, is to be disposed between the keytop 41 and case member 40C.

As shown from FIGS. 16 through 19, the case member 40C includes a main case body 42, and a lid 43 for covering an opening of the main case body 42. The main case body 42 contains an elastic member 44 and a slide member 45. A sheet 46 is placed over the elastic member 44 and slide member 45. The keytop 41 is placed over the lid 43.

The third embodiment differs from the first and second embodiments in the construction of a guide mechanism T3, with only the contact unit P omitted. The third embodiment is the same as the fist and second embodiments in other aspects.

Figure 17:
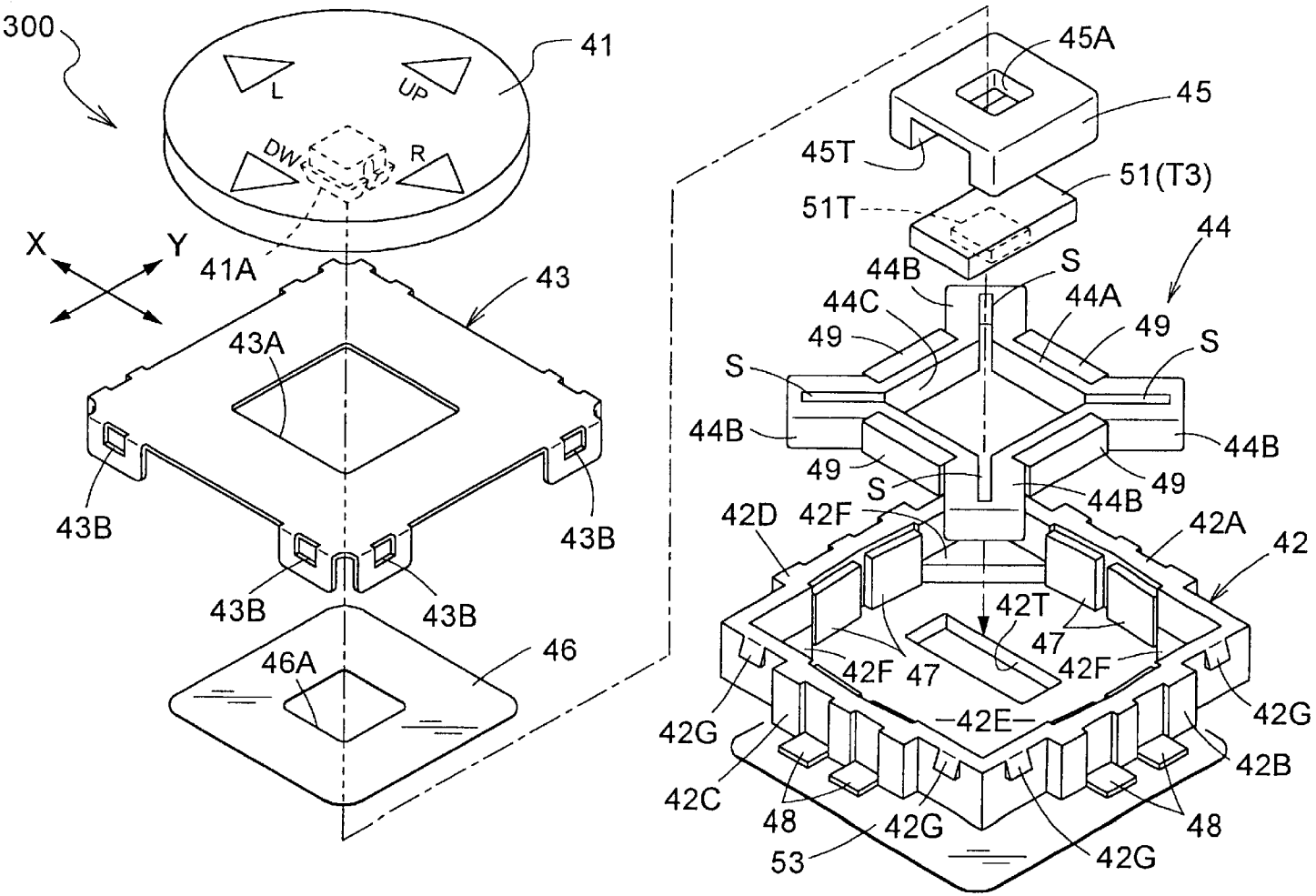
FIG. 17 is an exploded perspective view of the slide switch shown in FIG. 16.

As shown in FIG. 17, the guide mechanism T3 includes a guide bore 42T (one example of the one first guide) formed in the bottom wall 42E of the main case body 42 to extend along X-direction, an intermediate slide member 51 formed of plastic and having a portion 51T (one example of the other first guide) formed on a lower surface thereof for engaging the guide bore 42T, and a slide member 45 having a guide groove 45T formed in a lower surface thereof. The intermediate slide member 51 as a whole extends in Y-direction perpendicular to X-direction, i.e. has its longitudinal direction perpendicular to the guide bore 42T. The guide groove 45T (one example of the one second guide) formed in the lower surface of slide member 45 receives the intermediate slide member 51 (one example of the other second guide), and restricts the movement relative to the slide member 45 of the intermediate slide member 51 to Y-direction. As a result, the slide member 45 is sidable in X-direction, Y-direction, and composite directions combining X- and Y-directions without changing its angular posture (i.e. without rotating) relative to the main case body 42.

Figure 18:
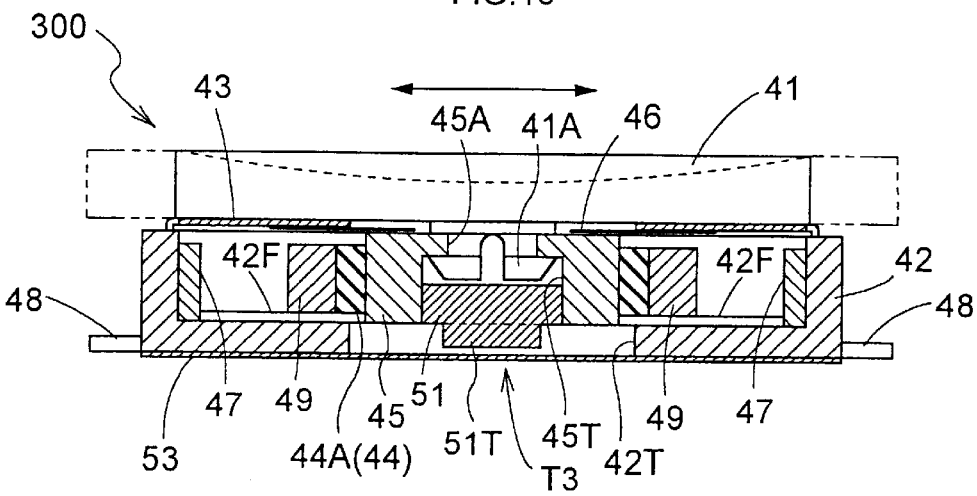
FIG. 18 is a side view in vertical section of the slide switch shown in FIG. 16.

As shown in FIGS. 17 and 18, a closure member 53 is provided to cover a lower surface (outer surface) of the bottom wall 42E of the main case body 42 to prevent entry of foreign matters to the main case body 42 through the guide bore 2T. The closure member 53 is formed of plastic film. The sheet 46 has a small friction factor and excellent sliding characteristic, and has a size for fitting in the main case body 42. The sheet 46 defines a square through hole 46A smaller than the slide member 45. Further, the keytop 41 has a shank 41A formed on a lower surface thereof for fitting in an engaging bore 45A of the slide member 45.

With each component constructed as described above, when assembling this slide switch 300, the intermediate slide member 51 is set in the main case body 42 with the lower projection 51T fitted in the guide bore 42T. The slide member 45 is set in place so that the intermediate slide member 51 fits in the guide groove 45T. The elastic member 44 is set to have the slide member 45 fitted in the opening 44C, and then the sheet 46 placed over the upper surface. Finally, the lid 43 is pressed toward the main case body 42. This pressing operation causes engaging opening 43B to engage a plurality of engaging projections 42G of the main case body 42. As a result, the lid 43 is secured to the main case body 42. Thereafter the shank 41A of the keytop 41 is inserted from above through the opening 43A of lid 43 and the opening 46A of sheet 46 to fit into the engaging bore 45A of slide member 45, to complete the slide switch 300. When mounting this slide switch 300 on a substrate (not shown), the slide switch is placed in position with the closure member 53 present between the bottoms of the slide switch and upper surfaces of patterns formed on the substrate, and conducting terminals 48 of the switch are fixedly soldered to the patterns, or otherwise connected to terminals on the substrate.

Figure 19:
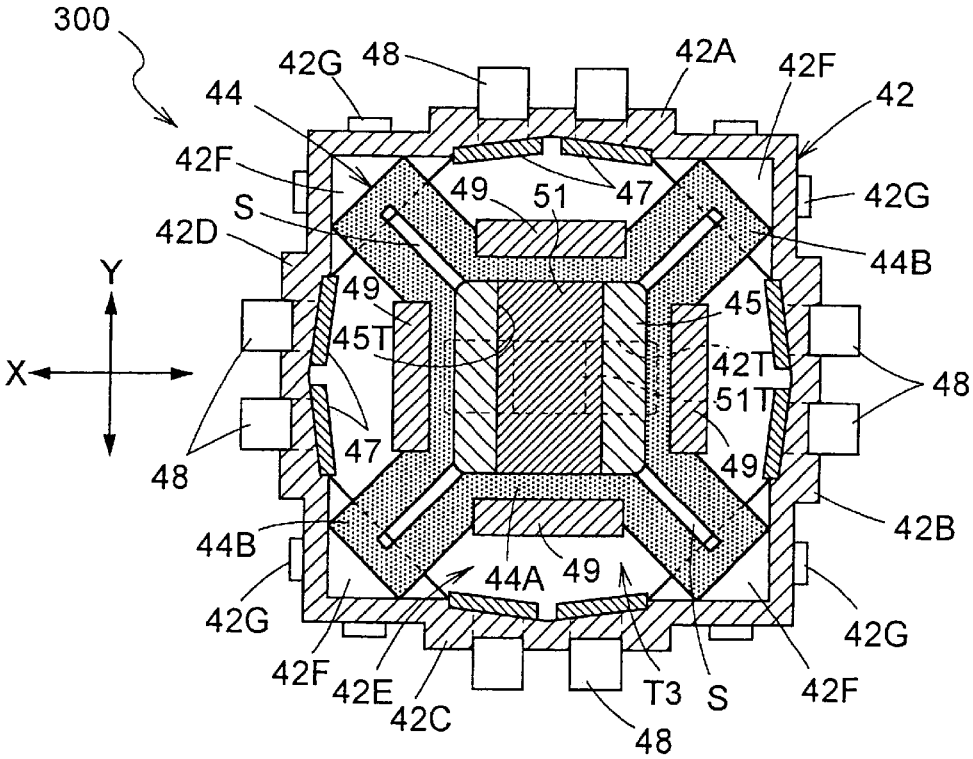
FIG. 19 is a cross-sectional plan view of the slide switch shown in FIG. 16.

With the slide switch 300 assembled as described above, when the keytop 41 is in neutral position N, as shown in FIG. 19, the slide member 45 is maintained at the center of the main case body 42 by the biasing force of the elastic member 44. The contacts 47 of the main case body 42 are separated from the conductors 49 of the elastic member 44. Thus, every contact 47 remains isolated from the corresponding conductor 49.

Figure 20:
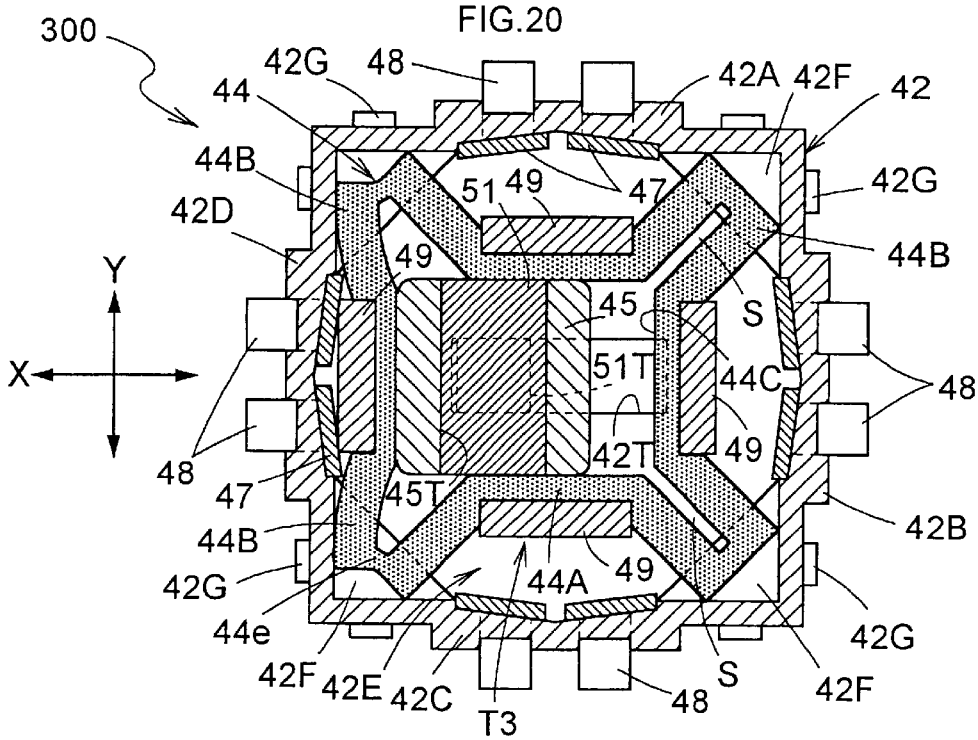
FIG. 20 is a cross-sectional plan view of the slide switch with an operating force applied to a slide member.

Next, when the keytop 41 is operated in a direction perpendicular to the side wall 42A, 42B, 42C or 42D (i.e. in a direction along either X-direction or Y-direction), e.g. toward the left side wall 42D in FIG. 20, the slide member 45 and intermediate slide member 51 move along the guide bore 42T. As a result, the side of the holding portion 44A of elastic member 44 downstream in the direction of operation is displaced toward the side wall 42D. The conductor 49 of the elastic member 44 thereby contacts the pair of contacts 47 on this side wall 42D to render the pair of contacts 47 conductive. The above displacement of the elastic member 44 expands the slits S of the two projecting portions 44B at opposite ends of that side of the holding portion 44. Thus, the projecting portions 44B allow the displacement while exerting an elastic biasing force on the slide member 45 in a restoring direction.

Figure 21:
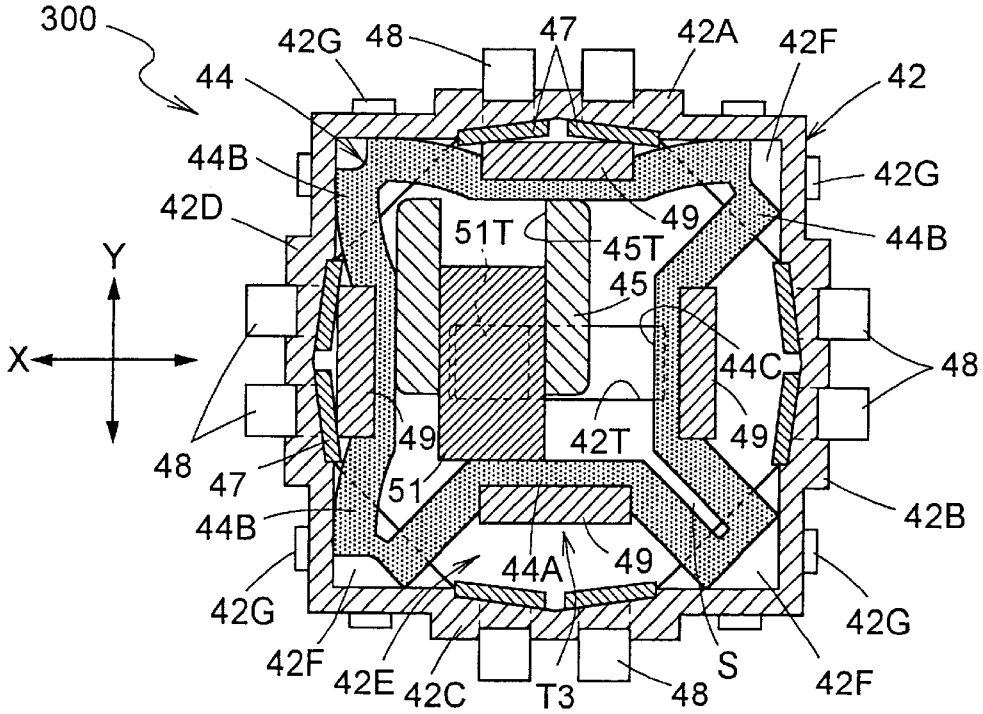
FIG. 21 is a cross-sectional plan view of the slide switch with a different operating force applied to the slide member.

When the keytop 41 is operated in a direction toward a comer of the main case body 42, e.g. in a direction between the upper side wall 42A and left side wall 42D in FIG. 21, the intermediate slide member 51 moves along the guide bore 42T, and at the same time the slide member 45 moves along the intermediate slide member 51. Thus, as shown in FIG. 21, the two sides of the holding portion 44A of elastic member 44 downstream in the direction of operation are simultaneously displaced toward the corresponding side walls 42A and 42D. As a result, the two conductors 49 of the elastic member 44 simultaneously contact the pairs of contacts 47 on the side walls 42A and 42D to render the pair of contacts 47 conductive. The above displacement of the elastic member 44 expands the slit S of the projecting portion 44B downstream in the direction of operation, to allow the movement of the slide member 45. The slits S of the two projecting portions 44B at opposite sides of the expanding slit S also expand. Thus, the projecting portions 44B allow the displacement while exerting an elastic biasing force on the slide member 45 in a restoring direction.

As a modification of the third embodiment, for example, the bottom wall 42E of the main case body 42 may have a guide groove instead of the guide bore 42T, or may have a guide rail protruding from the bottom wall 42E.

Fourth Embodiment

Figure 22:
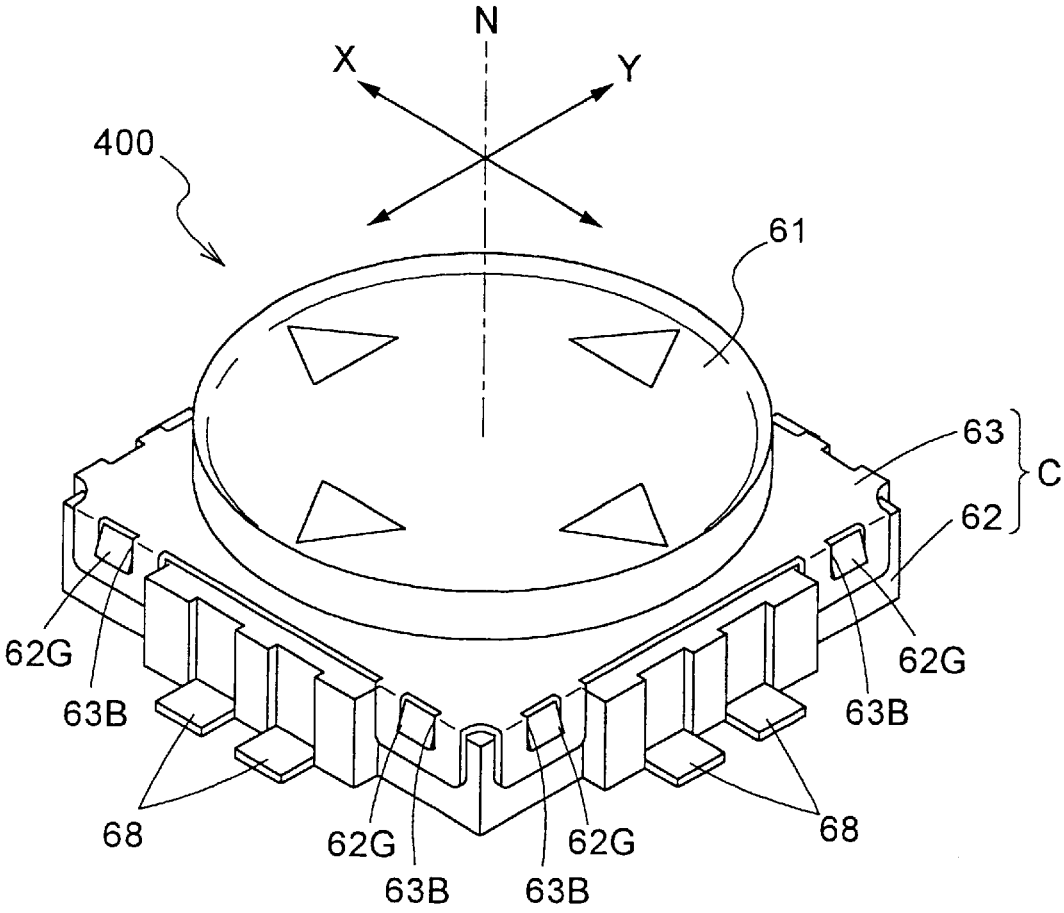
FIG. 22 is a perspective view of a slide switch in a fourth embodiment.
Figure 23:
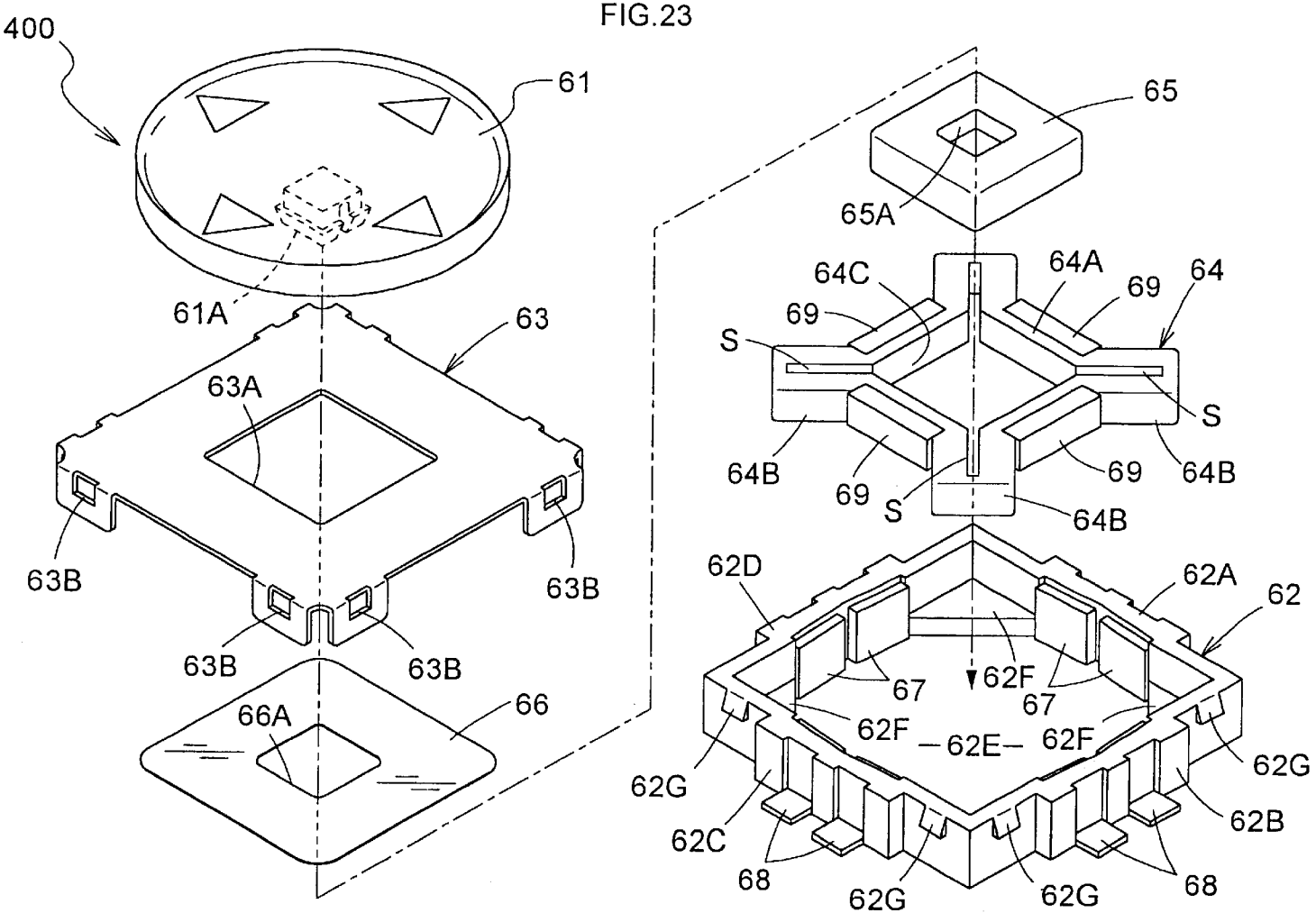
FIG. 23 is an exploded perspective view of the slide switch shown in FIG. 22.
Figure 24:
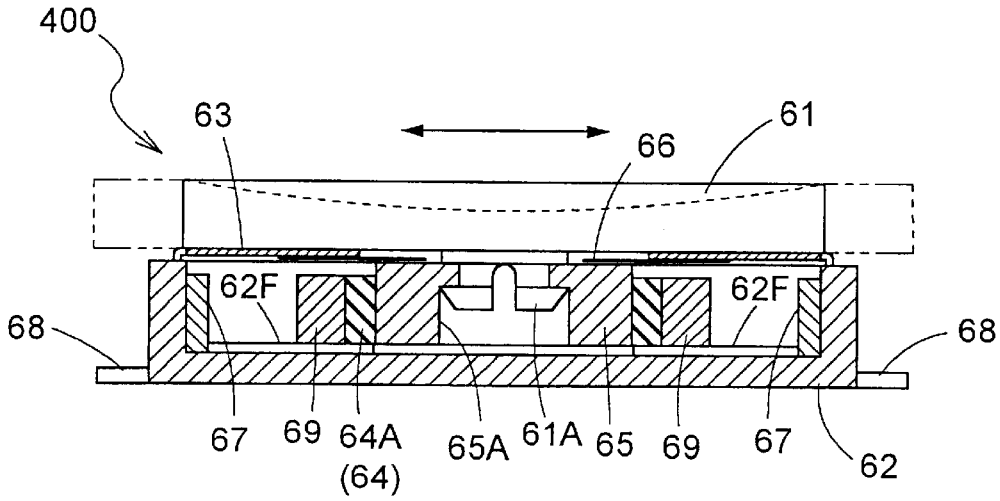
FIG. 24 is a side view in vertical section of the slide switch shown in FIG. 22.

The slide switch 400 shown in FIG. 22 as a fourth embodiment does not include the contact unit P, as described in the first and second embodiments, for detecting an operation to depress the keytop 1 in Z-direction, or the guide mechanism described in the third embodiment for preventing the slide member from rotating about an axis extending through the planar range of movement inside the main case body.

This slide switch 400 may also be used with a remote controller of a household electric appliance, a mobile phone, a controller of a game machine, a dashboard of a car, and so on.

The slide switch 400 includes a keytop 61 and a case member C as main components thereof. A panel of a household electric appliance, for example, is to be disposed between the keytop 61 and case member C.

As shown from FIGS. 22 through 25, the case member C includes a main case body 62, and a lid 63 for covering an opening of the main case body 62. The main case body 62 contains an elastic member 64 and a slide member 65. A sheet 66 is placed over the elastic member 64 and slide member 65. The keytop 61 is placed over the lid 63.

Figure 25:
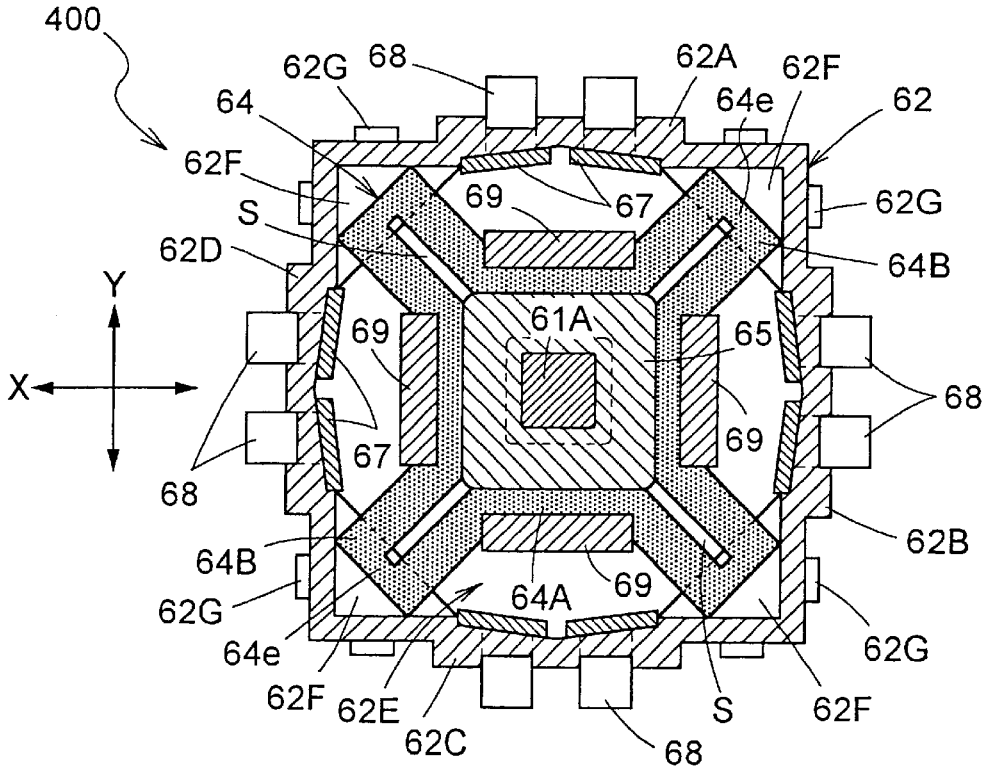
FIG. 25 is a cross-sectional plan view of the slide switch shown in FIG. 22.

The slide member 65 is slidable in a planar range of movement corresponding to the plane of FIG. 25. The main case body 62 includes four side walls 62A, 62B, 62C and 62D and a bottom wall 62E. The main case body 62 forms a square as seen in a direction perpendicular to the plane of the range of movement, and opens upward. The bottom wall 62E of main case body 62 includes, adjacent the four corners defined with the side walls 62A, 62B, 62C and 62D, supports 62F elevated from the level of a central region thereof. Each of the four side walls 62A, 62B, 62C and 62D forming a square has a pair of contacts 67. Conducting terminals 68 formed integral with these contacts 7 project from outer surfaces of the main case body 62. Further, the main case body 62 has a plurality of engaging projections 62G formed on outer surfaces of the four side walls 62A, 62B, 62C and 62D. On the other hand, the lid 63 has a square configuration and a size to cover the opening of the main case body 62. The lid 63 has an opening 63A formed centrally thereof, and lugs formed adjacent the corners and defining engaging openings 63B for receiving the engaging projections 62G of the main case body 62.

The elastic member 64 is formed of an elastomeric material elastically deformable and electrically nonconductive, such as silicon rubber, ethylene propylene rubber (EPDM) and nitrile rubber (NBR). The elastic member 64 is formed to have an integral construction including a holding portion 64A in the form of a hollow square frame smaller than the main case body 62, and four projecting portions 64B extending from the corners of the holding portion 64A toward the inner wall of the main case body 62. Each projecting portion 64B is formed of a pair of plate-like members separated by a slit S extending radially outwardly from the holding portion 64A, and joined at extreme ends thereof. The slit S is continuous with the opening 64C of the holding portion 64A. The holding portion 64A has, formed integral with the four side surfaces thereof opposed to the side walls 62A, 62B, 62C and 62D of the main case body 62, conductors 69 formed of a resin base containing a carbon material, for example.

In other words, the elastic member 64 includes a four-sided holding portion 64A extending circumferentially of the rectangular slide member 65, and pairs of projecting portions 64*b* extending from opposite ends of the holding portion 64A toward the four corners of the inner walls of main case body 62. A slit S is extends between each pair of projecting portions 64*b*. Each pair of projecting portions 64*b* have extreme ends thereof connected together. Each pair of projecting portions 64*b* includes, adjacent the extreme ends thereof, a pair of bend points 64*e* having a smaller sectional area than the other parts and elastically yieldable even to a slight external force. The elastic member 64 is placed above the bottom wall 62E, with extreme end regions of the projecting portions 64B placed on the four supports 62F. A greater part of the elastic member 64, particularly the entire holding portion 64A is freely movable within the planar range of movement formed in the main case body 62, without contacting the bottom wall 62E of the main case body 62.

The slide member 65 is formed of plastic to have a shape fitting tight in the opening 64C of the holding portion 64A of the elastic member 64. The slide member 65 has an engaging recess 65A formed centrally of an upper surface thereof. The sheet 66 is formed of plastic to have a small friction factor, and has outside dimensions for fitting in the main case body 62. The sheet 66 defines a square through hole 66A smaller than the slide member 65 as seen in the direction perpendicular to the planar range of movement of the slide member 65. A shank 61A formed on the lower surface of the keytop 61 extends through the through hole 66A to fit into the engaging bore 65A of the slide member 65.

When assembling this slide switch 400, the slide member 65 is set inside the main case body 62, with the extreme ends of projecting portions 64B placed on the supports 62F, the slide member 65 is fitted in the opening 64C of the elastic member 64, and the sheet 66 is placed over the upper surface. Finally, the lid 63 is pressed toward the main case body 62. This pressing operation causes the engaging openings 63B of the lid 63 to engage the plurality of engaging projections 62G of the main case body 62. As a result, the lid 63 is secured to the main case body 62. Thereafter the shank 61A of the keytop 61 is inserted from above through the opening 63A of lid 63 and the opening 66A of sheet 66 to fit into the engaging bore 65A of slide member 65, to complete the slide switch 400. When mounting this slide switch 400 on a substrate (not shown), the conducting terminals 68 are placed in position on patterns formed on the substrate and fixed by soldering, or the conducting terminals 68 of the switch may be connected to terminals on the substrate.

With the slide switch 400 assembled as described above, when the keytop 61 is in neutral position N, as shown in FIG. 25, the slide member 65 is maintained at the center of the main case body 62 by the biasing force of the elastic member 64. The contacts 67 of the main case body 62 are separated from the conductors 69 of the elastic member 64. Thus, every contact 67 remains isolated from the corresponding conductor 69.

Figure 26:
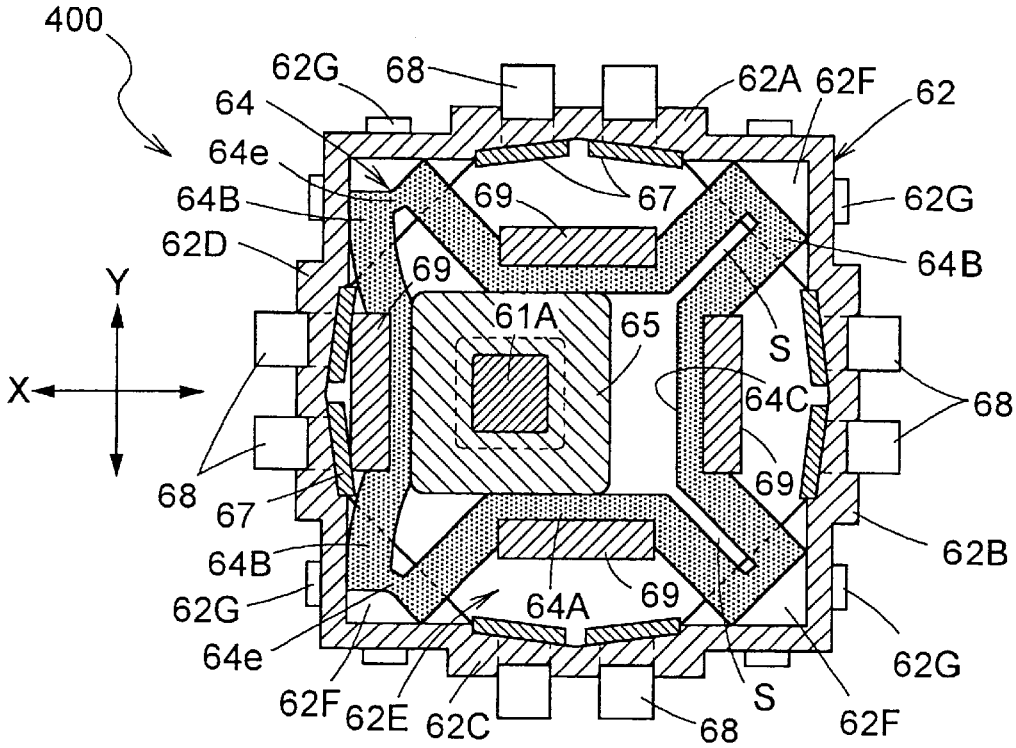
FIG. 26 is a cross-sectional plan view of the slide switch with an operating force applied to a slide member.

Next, when the keytop 61 is operated in a direction perpendicular to the side wall 62A, 62B, 62C or 62D (i.e. in a direction along either X-direction or Y-direction), e.g. toward the left side wall 62D in FIG. 26, the side of the holding portion 64A of elastic member 64 downstream in the direction of operation is displaced toward the side wall 62D since the projection portions 64*b* on the left side of the elastic member 64 undergo an elastic deformation at the bend points 64*e*. The conductor 69 of the elastic member 64 thereby contacts the pair of contacts 67 on this side wall 62D to render the pair of contacts 67 conductive. The above displacement of the elastic member 64 expands the slits S of the two projecting portions 64B at opposite ends of that side of the holding portion 64. Thus, the projecting portions 64B allow the displacement while exerting an elastic biasing force on the slide member 65 in a restoring direction.

Figure 27:
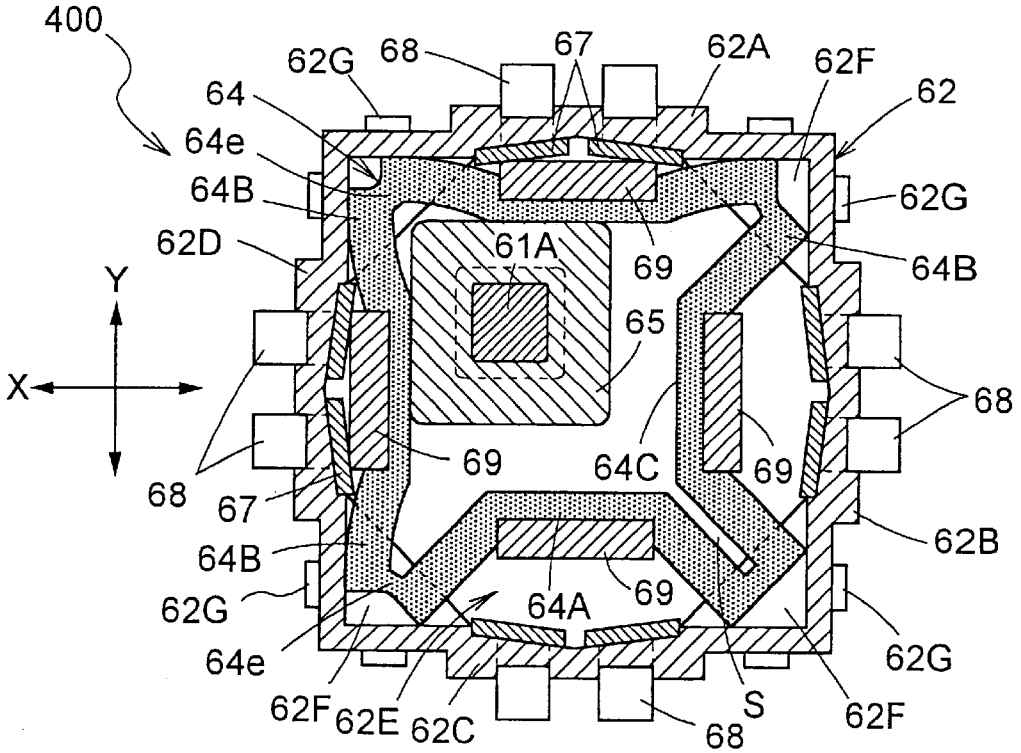
FIG. 27 is a cross-sectional plan view of the slide switch with a different operating force applied to the slide member.

When the keytop 61 is operated in a direction toward a comer of the main case body 62, e.g. in a direction between the upper side wall 62A and left side wall 62D in FIG. 27, one comer of the slide member 5 forces into the slit S of one of the projecting portions 64B. The two sides of the holding portion 64A of elastic member 64 downstream in the direction of operation are simultaneously displaced toward the corresponding side walls 62A and 62D since the projection portions 64*b* of the elastic member 64 undergo an elastic deformation at the three bend points 64*e*. As a result, the two conductors 69 of the elastic member 64 simultaneously contact the pairs of contacts 67 on the side walls 62A and 62D to render the pair of contacts 67 conductive. The above displacement of the elastic member 64 expands the slit S of the projecting portion 64B downstream in the direction of operation, to allow the movement of the slide member 65. The slits S of the two projecting portions 64B at opposite sides of the expanding slit S also expand. Thus, the projecting portions 64B allow the displacement while exerting an elastic biasing force on the slide member 65 in a restoring direction.

The inner walls of the main case body 62, i.e. the interior surface of the side walls 62A, 62B, 62C and 62D, and outer surfaces of the slide member 65, are all square (one example of common polygons). When the keytop 61 is free from an external force, these square side surfaces are maintained parallel to each other by the action of the elastic member 64 to maintain the position and angular posture of the slide member 65 relative to the main case body 62 in neutral state as shown in FIG. 25. Thus, the slide member 65, not only when operated to slide in the four, up and down and right and left directions, but also when operated in a composite direction between two adjacent directions, is maintained in a position to realize a desired switching by contact between each inner side wall of the main case body 62 and opposed side of the slide member 65. In other words, even when certain rotatory force about Z-axis is applied to the keytop 61, the above construction effectively avoids a situation where a non-corresponding pair of contact 67 and conductor 69 contact each other. This assures a reliable switching operation and an agreeable operational feeling.

Fifth Embodiment

The fifth embodiment, as a modification of the fourth embodiment, includes a construction for operating a keytop 71 in X- and Y-directions, and besides for depressing the keytop 71 in Z-direction perpendicular to X- and Y-directions, and a mechanism for electrically detecting this operation. This detecting mechanism is different from the mechanism in the first and second embodiments.

Figure 28:
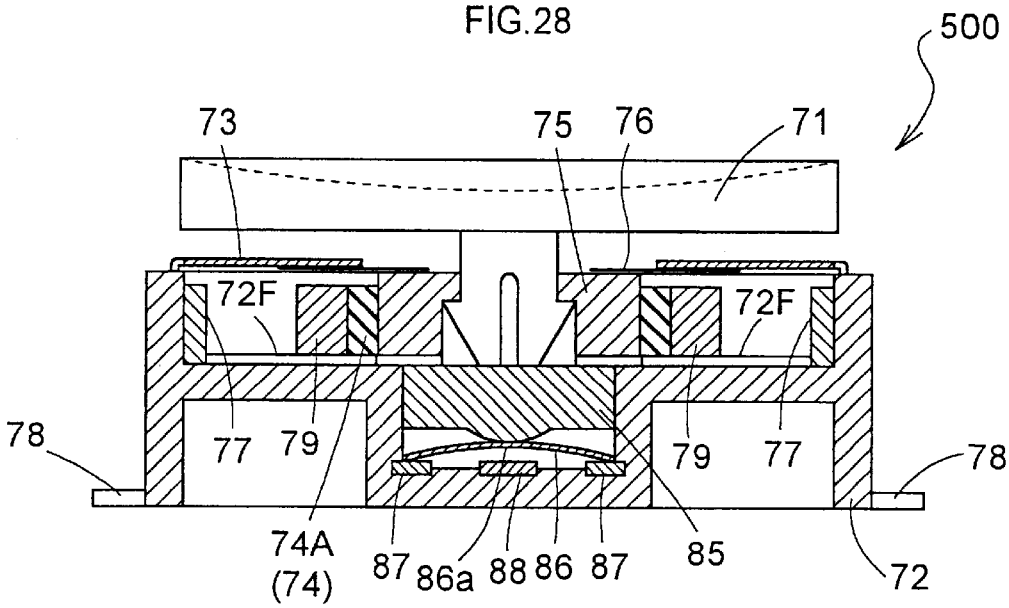
FIG. 28 is a side view in vertical section of a slide switch in a fifth embodiment.

The slide switch 500 shown in FIG. 28 as the fifth embodiment includes an intermediate lift member 85 disposed below a slide member 75 to be vertically displaceable relative to a main case body 72, and an auxiliary elastic member 86 for contacting the lower surface of intermediate lift member 85. The main case body 72 includes, arranged on a bottom surface thereof, an annular, first fixed contact 87 (one example of auxiliary conducting device), and a second fixed contact 88 (one example of auxiliary conducting device) disposed adjacent the center of the first fixed contact 87. The auxiliary elastic member 86 has an outer periphery constantly in contact with the first fixed contact 87.

When a manual operating force is applied to depress the keytop 71 along Z-axis perpendicular to a planar range of movement (a plane including X- and Y-directions), this operating force downwardly displaces the intermediate lift member 85 while elastically deforming the auxiliary elastic member 86. As a result, a movable contact 86*a* (one example of auxiliary conducting device) formed on the back side of a domed central portion of the auxiliary elastic member 86 moves into contact with the second fixed contact 88. Upon removable of the operating force applied to the keytop 71, the elastic restoring force of the auxiliary elastic member 86 separates the movable contact 86*a* on the auxiliary elastic member 86 from the second fixed contact 88 to eliminate the conductive state.

What is claimed is:

1. A slide switch comprising:

a case member;

a slide member movable in a planar range of movement defined in said case member;

a conducting device formed between said case member and said slide member; and an elastic member having a holding portion engaged with said slide member, and projecting portions extending from said holding portion along said planar range of movement toward inner walls of said case member;

said elastic member being formed of an electrically insulating material;

said conducting device including contacts arranged on said inner walls of said case member, and conductors arranged on said holding portion of said elastic member;

by a biasing force of said elastic member, said slide member being held at a neutral position where said conductors arranged on said elastic member are away from said contacts arranged on said inner walls of said case member, said conductors arranged on said elastic member being movable into contact with said contacts arranged on said case member by an external force by moving said slide member away from said neutral position against the biasing force of said elastic member; and a guide mechanism for maintaining said slide member in a fixed angular posture about an axis perpendicular to said planar range of movement regardless of movement of said slide member caused by said external force;

wherein said guide mechanism includes an intermediate slide member disposed between said slide member and a bottom surface of said case member, with a first guide formed between said bottom surface of said case member, with a first guide formed between said bottom surface of said case member and said intermediate slide member for guiding said intermediate slide member to move along an X-axis relative to said case member, and a second guide formed between said slide member and said intermediate slide member for guiding said slide member to move along a Y-axis intersecting said X-axis relative to said intermediate slide member.

2. A slide switch as defined in claim 1, wherein said inner walls of said case member and outer surfaces of said slide member have a common polygonal shape, each of said outer surfaces of said slide member being maintained parallel to an opposed one of said inner walls of said case member said case member by said biasing force of said elastic member, absent said external force.

3. A slide switch as defined in claim 1, wherein said inner walls of said case member and said holding portion of said elastic member form squares having four sides as seen in a direction perpendicular to said planar range of movement, said projecting portions of said elastic member extending from respective corners of said square of said holding portion toward respective corners defined by said inner walls of said case member, and wherein said contacts are formed on the inner walls of said case member, respectively, and said conductors are formed on the four sides of said holding portion of said elastic member, respectively.

4. A slide switch as defined in claim 1, wherein said case member includes support portions formed in the respective corners thereof for supporting said projecting portions of said elastic member to maintain said holding portion in a state spaced from a bottom surface of said case member.

5. A slide switch as defined in claim 1, wherein said elastic member includes bend points elastically yieldable even to a slight external force.

6. A slide switch as defined in claim 1, wherein each of said projecting portions of said elastic member has a pair of plate-like members separated by a slit extending radially outwardly from said holding portion, and joined together at extreme ends thereof.

7. A slide switch as defined in claim 1, wherein each of said projecting portions has, formed at an extreme end thereof, a bend point elastically yieldable even to a slight external force.

8. A slide switch comprising:

a case member;

a slide member movable in a planar range of movement defined in said case member;

a conducting device formed between said case member and said slide member; and an elastic member having a holding portion engaged with said slide member, and projection portions extending from said holding portion along said planar range of movement toward inner walls of said case member;

said elastic member being formed of an electrically insulating material;

said conducting device including contacts arranged on said inner walls of said case member, and conductors arranged on said holding portion of said elastic member;

by a biasing force of said elastic member, said slide member being held at a neutral position where said conductors arranged on said elastic member are away from said contacts arranged on said inner walls of said case member, said conductors arranged on said elastic member being movable into contact with said contacts arranged on said case member by an external force by moving said slide member away from said neutral position against the biasing force of said elastic member; and a guide mechanism for maintaining said slide member in a fixed angular posture about an axis perpendicular to said planar range of movement regardless of movement of said slide member caused by said external force;

wherein said guide mechanism includes an intermediate slide member disposed between said slide member and a lid covering an upper surface of said case member, with a first guide formed between said slide member and said intermediate slide member for guiding said intermediate slide member to move along an X-axis relative to said lid, and a second guide formed between said lid and said intermediate slide member for guiding said slide member to move along a Y-axis intersecting said X-axis relative to said intermediate slide member; and wherein a control member is supported outside said case member for receiving a manual operating force and transmitting said manual operating force to said slide member, with a connector provided between said control member and said slide member for transmitting said manual operating force.

9. A slide switch as defined in claim 8, wherein said inner walls of said case member and outer surfaces of said slide member have a common polygonal shape, each of said outer surfaces of said slide member being maintained parallel to an opposed one of said inner walls of said case member said case member by said biasing force of said elastic member, absent said external force.

10. A slide switch as defined in claim 8, wherein said inner walls of said case member and said holding portion of said elastic member form squares having four sides as seen in a direction perpendicular to said planar range of movement, said projecting portions of said elastic member extending from respective corners of said square of said holding portion toward respective corners defined by said inner walls of said case member, and wherein said contacts are formed on the inner walls of said case member, respectively, and said conductors are formed on the four sides of said holding portion of said elastic member, respectively.

11. A slide switch as defined in claim 8, wherein said case member includes support portions formed in the respective corners thereof for supporting said projecting portions of said elastic member to maintain said holding portion in a state spaced from a bottom surface of said case member.

12. A slide switch as defined in claim 8, wherein said elastic member includes bend points elastically yieldable even to a slight external force.

13. A slide switch as defined in claim 8, wherein each of said projecting portions of said elastic member has a pair of plate-like members separated by a slit extending radially outwardly from said holding portion, and joined together at extreme ends thereof.

14. A slide switch as defined in claim 8, wherein each of said projecting portions has, formed at an extreme end thereof, a bend point elastically yieldable even to a slight external force.

15. A slide switch comprising:

a case member;

a slide member movable in a planar range of movement defined in said case member;

a conducting device formed between said case member and said slide member; and an elastic member having a holding portion engaged with said slide member, and projecting portions extending from said holding portion along said planar range of movement toward inner walls of said case member;

said elastic member being formed of an electrically insulating material;

said conducting device including contacts arranged on said inner walls of said case member, and conductors arranged on said holding portion of said elastic member;

by a biasing force of said elastic member, said slide member being held at a neutral position where said conductors arranged on said elastic member are away from said contacts arranged on said inner walls of said case member, said conductors arranged on said elastic member being movable into contact with said contacts arranged on said case member by an external force by moving said slide member away from said neutral position against the biasing force of said elastic member; and an auxiliary conducting device electrically switchable on and off by an external force applied to said slide member and acting along a Z-axis perpendicular to said planar range of movement;

wherein there is further provided an auxiliary elastic member elastically deformable by said external force acting along said Z-axis, said auxiliary conducting device including a fixed contact formed on a bottom surface of said case member, and a movable contact formed on said auxiliary elastic member for contacting said fixed contact in response to said external force along said Z-axis, and separable from said fixed contact upon removal of said external force acting along said Z-axis.

16. The slide switch according to claim 15, wherein said auxiliary elastic member comprises a dome-shaped member having a concave side opposed to said surface of said case member, and a convex side opposed to said slide member, at least said concave side being formed of a conductive material acting as said movable contact.

17. The slide switch according to claim 15, further comprising:

a guide mechanism for maintaining said slide member in a fixed angular posture about an axis perpendicular to said planar range of movement regardless of movement of said slide member caused by said external force;

wherein said guide mechanism includes an intermediate slide member disposed between said slide member and a lid covering an upper surface of said case member, and a guide member disposed between said slide member and said auxiliary elastic member;

a first guide being formed between said slide member and said intermediate slide member for guiding said intermediate slide member to move along an X-axis relative to said lid, and a second guide being formed between said lid and said intermediate slide member for guiding said slide member to move along a Y-axis intersecting said X-axis relative to said intermediate slide member;

said guide member supporting said slide member movable within said planar range of movement, and deformable along a Z-axis perpendicular to said planar range of movement.

18. The slide switch according to claim 15, further comprising:

a guide mechanism for maintaining said slide member in a fixed angular posture about an axis perpendicular to said planar range of movement regardless of movement of said slide member caused by said external force;

wherein said guide mechanism includes an intermediate slide member disposed between said slide member and said auxiliary elastic member, and a guide member disposed between said intermediate slide member and said auxiliary elastic member;

a first guide being formed between said guide member and said intermediate slide member for guiding said intermediate slide member to move along an X-axis relative to said case member, and a second guide being formed between said slide member and said intermediate slide member for guiding said slide member to move along an a Y-axis intersecting said X-axis relative to said intermediate slide member;

said guide member supporting said intermediate slide member movable within said planar range of movement, and deformable along a Z-axis perpendicular to said planar range of movement.

19. A slide switch as defined in claim 15, wherein said inner walls of said case member and outer surfaces of said slide member have a common polygonal shape, each of said outer surfaces of said slide member being maintained parallel to an opposed one of said inner walls of said case member said case member by said biasing force of said elastic member, absent said external force.

20. A slide switch as defined in claim 15, further comprising a control member supported outside said case member for receiving a manual operating force, said control member and said slide member being connected to each other whereby said manual operating force received by said control member is transmitted to said slide member.

* * * * *